US008026030B2

(12) United States Patent
Moribe et al.

(10) Patent No.: US 8,026,030 B2
(45) Date of Patent: Sep. 27, 2011

(54) TONER

(75) Inventors: Syuhei Moribe, Numazu (JP); Katsuhisa Yamazaki, Numazu (JP); Shuichi Hiroko, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 680 days.

(21) Appl. No.: 11/556,500

(22) Filed: Nov. 3, 2006

(65) Prior Publication Data

US 2007/0105033 A1 May 10, 2007

(30) Foreign Application Priority Data

Nov. 7, 2005 (JP) ..... 2005-321883

(51) Int. Cl.
*G03G 9/087* (2006.01)

(52) U.S. Cl. ..... 430/108.1; 430/109.1; 430/109.3; 430/109.4

(58) Field of Classification Search ..... 430/108.1, 430/109.1, 109.3, 109.4
See application file for complete search history.

(56) References Cited

U.S. PATENT DOCUMENTS

| | | | | |
|---|---|---|---|---|
| 2,297,691 | A | 10/1942 | Carlson | 430/55 |
| 4,588,668 | A | 5/1986 | Yasuda et al. | 430/109 |
| 5,210,579 | A | 5/1993 | Setoriyama et al. | 355/285 |
| 5,512,401 | A * | 4/1996 | Sacripante et al. | 430/109.5 |
| 5,525,775 | A | 6/1996 | Setoriyama et al. | 219/216 |
| 5,552,254 | A * | 9/1996 | Mychajlowsky et al. | 430/109.5 |
| 5,723,511 | A * | 3/1998 | Kazmaier et al. | 522/35 |
| 5,773,510 | A | 6/1998 | Kazmaier et al. | 525/26 |
| 5,880,195 | A * | 3/1999 | Kalinowski et al. | 524/426 |
| 5,962,176 | A | 10/1999 | Ohno et al. | 430/109 |
| 6,017,669 | A | 1/2000 | Unno et al. | 430/109 |
| 6,114,499 | A * | 9/2000 | Kazmaier et al. | 528/480 |
| 6,238,835 | B1 * | 5/2001 | Tavernier et al. | 430/109.4 |
| 6,485,875 | B1 * | 11/2002 | Karaki et al. | 430/108.23 |
| 6,593,052 | B2 * | 7/2003 | Yoshikawa et al. | 430/108.5 |
| 6,610,454 | B2 | 8/2003 | Hashimoto et al. | 430/109.2 |
| 6,664,016 | B2 * | 12/2003 | Kanbayashi et al. | 430/108.23 |
| 6,808,852 | B2 * | 10/2004 | Hotta et al. | 430/108.22 |
| 6,905,808 | B2 * | 6/2005 | Itakura et al. | 430/45.5 |
| 6,929,894 | B2 * | 8/2005 | Sugahara et al. | 430/108.3 |
| 7,001,703 | B2 * | 2/2006 | Moribe et al. | 430/109.4 |
| 7,026,086 | B2 * | 4/2006 | Kashiwabara et al. | 430/108.4 |
| 7,056,634 | B2 * | 6/2006 | Ishii et al. | 430/108.23 |
| 7,115,349 | B2 * | 10/2006 | Iida et al. | 430/108.24 |
| 7,267,919 | B2 * | 9/2007 | Moribe et al. | 430/108.23 |
| 7,517,627 | B2 * | 4/2009 | Kashiwabara et al. | 430/109.3 |

(Continued)

FOREIGN PATENT DOCUMENTS

EP 0 735 064 A1 10/1996

(Continued)

*Primary Examiner* — Hoa Le
(74) *Attorney, Agent, or Firm* — Fitzpatrick, Cella, Harper & Scinto

(57) ABSTRACT

The present invention provides a toner which is excellent in low-temperature fixability and transparency and has high gloss, and which is excellent in offset resistance, storage stability, and development stability. The toner is characterized in that: a square radius of inertia Rt at a peak top of a main peak in GPC-RALLS-viscometer analysis of tetrahydrofuran (THF) soluble matter when the toner is dissolved in a THF solvent at 25° C. for 24 hours is 1.0 nm to 3.8 nm; and the square radius of inertia Rt and a square radius of inertia Rp at a peak top of a main peak in GPC-RALLS-viscometer analysis of THF soluble matter when linear polystyrene, having an absolute peak molecular weight value at the same value as a main peak value of the toner, is dissolved in a THF solvent at 25° C. for 24 hours satisfy the relationship of Rt/Rp<0.85.

2 Claims, 4 Drawing Sheets

1. Heat cylinder
2. Paddle
3. Vent opening
4. Feeding port
5. Discharging port
6. Raw material hopper

U.S. PATENT DOCUMENTS

| | | | | |
|---|---|---|---|---|
| 2003/0134215 | A1* | 7/2003 | Kashiwabara et al. | 430/108.4 |
| 2004/0081905 | A1* | 4/2004 | Moribe et al. | 430/108.3 |
| 2004/0115549 | A1* | 6/2004 | Ishii et al. | 430/108.23 |
| 2004/0137353 | A1* | 7/2004 | Iida et al. | 430/108.24 |
| 2004/0142266 | A1* | 7/2004 | Sacripante et al. | 430/109.3 |
| 2005/0106485 | A1 | 5/2005 | Yamazaki et al. | 430/106.1 |
| 2006/0051693 | A1* | 3/2006 | Sata et al. | 430/109.4 |
| 2006/0063086 | A1* | 3/2006 | Sacripante et al. | 430/109.4 |
| 2006/0088779 | A1* | 4/2006 | Sacripante et al. | 430/108.4 |
| 2007/0026336 | A1 | 2/2007 | Yamazaki et al. | 430/109 |

FOREIGN PATENT DOCUMENTS

| | | |
|---|---|---|
| EP | 0 901 046 A1 | 3/1999 |
| EP | 1 096 326 A2 | 5/2001 |
| JP | 42-023910 | 11/1942 |
| JP | 43-024748 | 10/1943 |
| JP | 59-228658 | 12/1984 |
| JP | 62-195678 | 8/1987 |
| JP | 03-203746 | 9/1991 |
| JP | 04-024648 | 1/1992 |
| JP | 04-044075 | 2/1992 |
| JP | 04-204980 | 7/1992 |
| JP | 07-230188 | 8/1995 |
| JP | 09-006050 | 1/1997 |
| JP | 09-146305 | 6/1997 |
| JP | 2002-099110 | 4/2002 |
| JP | 2004-151438 | 5/2004 |

* cited by examiner

1. Heat cylinder
2. Paddle
3. Vent opening
4. Feeding port
5. Discharging port
6. Raw material hopper

TONER

BACKGROUND OF THE INVENTION

1. Field of the Invention

The present invention relates to a toner for use in an image forming method intended for visualizing an electrophotograph, or an electrostatic charge image.

2. Description of the Related Art

A large number of image forming methods such as electrostatic recording methods, magnetic recording methods, and toner jet methods have been conventionally known. For example, a large number of electrophotographic methods have been known (see, for example, U.S. Pat. No. 2,297,691, JP 42-23910 B, and JP 43-24748 B). Electrophotographic methods generally involve: utilizing a photoconductive substance first to form an electrostatic latent image on a photosensitive member of various means; next, developing the latent image with toner to provide a visible image; transferring the toner onto a transfer material such as paper as required; and then fixing the toner image onto the transfer material by using heat, pressure, or the like to provide a copied article. The toner remaining on the photosensitive member without being transferred is cleaned by various methods, and then the above-mentioned steps are repeated.

Various methods and device have been developed for the step of fixing the toner image onto a sheet such as paper, as the above-mentioned final step. A method commonly used in recent years is a pressure and heat fixing system using a heat roller. The pressure and heat fixing system using a heat roller involves passing the transfer material while bringing a surface of the heat roller having releasability with respect to toner and a surface of a toner image on the transfer material into contact with each other under pressure to fix the toner image. In the mode, the surface of the heat roller and the toner image on the transfer material are brought into contact with each other under pressure, so the mode provides extremely good thermal efficiency upon fusion of the toner image onto the transfer material, and allows fixation to be quickly performed.

By the way, various different toners have been used in copying machines and printers depending on models of the copying machines and the printers. This is mainly due to differences in fixation speed and fixation temperature. In other words, the reason for the foregoing is that fixability or a gloss of a fixed image is largely affected by the fixation speed or temperature because the surface of the heat roller and the toner image in a molten state are brought into contact with each other under pressure. General setting is as follows: the temperature of the surface of the heat roller is set to be low when a fixation speed is low, while the temperature of the surface of the heat roller is set to be high when the fixation speed is high. This is due to a need for keeping a quantity of heat to be applied by the heat roller to the toner at a nearly constant value irrespective of the fixation speed in order that the toner may be fixed onto the transfer material.

Under such circumstances, a user's preference for, in particular, gloss varies from image to image, so it has been desired that the user should be capable of selecting a level of glossiness. A relationship between a loss modulus G" and a temperature at which the loss modulus is obtained has been described as an approach for controlling the gloss (see, for example, JP 2002-099110 A and JP 2004-151438 A). However, a temperature region in which desired gloss can be obtained in each of the documents cannot be said to be sufficient, and is still susceptible to improvement.

In addition, when the quantity of heat to be applied onto the transfer material varies, the gloss of an image to be obtained also varies. Suppose, for example, the following case: when the transfer material is passed through a fixing unit, the temperature of a heat roller decreases so that the quantity of heat to be applied to a leading end portion of the transfer material at the time of onset of fixation is different from the quantity of heat to be applied to a rear end portion of the transfer material at the time of completion of the fixation. In this case, the end portions of the resultant image are different from each other in gloss. One is apt to have a feeling of discrepancy in a case of a full-color image in particular. Further, when a large number of images are continuously outputted, the temperature of the heat roller decreases, with a result that an image at the time of onset of the image output and an image to be obtained at the time of completion of the image output are different from each other in gloss in some cases.

In addition, a fixing device according to a film heating mode has been recently put into practical use from the viewpoints of quick start property and energy savings (see, for example, JP 04-44075 A and JP 04-204980 A). However, the fixing device is problematic in terms of quantity of heat when the device is used for a full-color image forming device or a high-speed machine, each of which requires a large quantity of heat. In addition, in the fixing device, applied pressure of a fixing nip portion cannot be made very large, so the device is problematic in terms of improvements in gloss and speed.

Further, a toner has been desired which not only allows a toner image to be certainly brought into close contact with paper but also prevents a fixing roller from generating, for example, an offset upon fixation, and which does not cause any image defect due to a stress after the fixation.

Meanwhile, a method of increasing a degree of branching of a polymer of a vinyl resin by using a macromonomer (see, for example, JP 03-87753 A and JP 03-203746 A), and a method involving use of a hydroxy vinyl monomer modified with ϵ'-caprolactone (see, for example, JP 04-24648 A) have been proposed. However, when a large number of macromonomers are used for increasing the degree of branching in each of those methods, a glass transition temperature of the resin decreases, and storage stability of the toner reduces. Examples of a method of keeping the storage stability of the toner at a good level include: a method involving increasing molecular weight of a main chain of the polymer to increase the glass transition temperature of the main chain of the polymer; and a method involving changing a monomer composition of the main chain of the polymer without changing the molecular weight of the main chain to increase only the glass transition temperature of the main chain. However, any of those methods increase the fixation temperature. In addition, a lowering effect of the temperature at which the toner is fixed due to an increase in the degree of branching is small, so an improvement in gloss is difficult to be obtained.

A method involving the use of: a polyvalent carboxylic acid which is trivalent or more or a polyhydric alcohol which is trivalent or more; or a dicarboxylic acid having a side chain or a diol having a side chain has been proposed as a method of increasing the degree of branching of a polyester resin (see, for example, JP 59-228658 A and JP 62-195678 A). However, the method involving the use of a polyvalent carboxylic acid which is trivalent or more or a polyhydric alcohol which is trihydric or more increases an amount of a gel component (i.e., THF insoluble matter), though the method increases the degree of branching. As a result, hot offset resistance is improved, but a fixation temperature is increased.

A relationship between weight average molecular weight measured by a light scattering method and weight average molecular weight measured by GPC of a component showing a molecular weight of 50,000 or less in a molecular weight distribution by GPC in a THF soluble matter of a toner binder resin has been described (see, for example, JP-09-6050 A). In addition, a relationship between a weight average molecule weight measured by a light scattering method and an inertial radius in a toner binder resin having a molecular weight in a region of 2,000 to 100,000 has been described (see, for example, JP 09-146305 A). Further, a toner containing the low-molecular-weight polymer component whose molecular weight is 50,000 or less and, whose branching index is less than one has been described (see for example, JP 07-230188A). However, the toner binder resin described in each of those documents has a low degree of branching and a limited molecular weight range. Accordingly, the resin cannot sufficiently take balance of low-temperature fixability, offset resistance, and night gloss at a high level.

Further, the respective color toners mounted on a full-color copying machine or printer must be sufficiently mixed in a heat pressure fixing step without an impairment of an improvement in color reproducibility or transparency of an overhead projector (OHP) image.

For example, a toner containing a linear polymer excellent in low-temperature fixability, gloss, and OHP image transparency as the binder resin has been described (see, for example, JP 2002-07255 A). However, the toner is still susceptible to improvement in a recent high-speed developing system.

As described above, in a high-speed developing system, a toner has been desired which provides a high-quality image without causing any image defect due to a stress after fixation, and which provides an image having a constant gloss width in a wide temperature region irrespective of the constitution of a fixing unit.

SUMMARY OF THE INVENTION

An object of the present invention is to provide a toner which is excellent in low-temperature fixability and transparency and has high gloss even in a high-speed developing system and a low-pressure fixing system, and which is excellent in offset resistance, storage stability, and development stability.

The inventors of the present invention have made studies with a view to achieving the above-mentioned object. As a result, they have found that a use of a toner composed of a binder resin containing a branched low-molecular weight resin component can provide a toner showing excellent low-temperature fixability and high gloss even in a high-speed developing system. In view of the foregoing, the inventors have decided to: provide a binder resin containing an appropriately branched low-molecular weight resin component by specifying a value for a square radius or inertia Rt at a peak top of a main peak in tetrahydrofuran (THF) soluble matter when a toner is dissolved in a THF solvent at 25° C., and specifying a ration between the value for the square radius of inertia Rt and a square radius of inertia Rp in linear polystyrene having an absolute peak molecular weight value at the same value as the main peak value; and solve the above-mentioned problems by using the binder resin.

That is, the present invention is as described below.

(1) A toner, including at least: a binder resin; and a colorant, in which: a square radius of inertia Rt at a peak top of a main peak in GPC-RALLS-viscometer analysis of tetrahydrofuran (THF) soluble matter when the toner is dissolved in a THF solvent at 25° C. for 24 hours is 1.0 nm to 3.8 nm; and the square radius of inertia Rt and a square radius of inertia RP at a peak top of a main peak in GPC-RALLS-viscometer analysis of THF soluble matter when linear polystyrene, having an absolute peak molecular weight value at the same value as a main peak value of the toner, is dissolved in a THF solvent at 25° C. for 24 hours satisfy the following expression 1:

$$Rt/Rp<0.85 \quad \text{(Ex. 1)}$$

(2) A toner according to the above-mentioned item (1), in which a ratio of molecules each having the square radius of inertia of 5 nm or less to an entire peak area of the toner in the GPC-RALLS-viscometer analysis is 60 to 100 mass %.

(3) A toner according to the above-mentioned item (1) or (2), in which the binder resin contains at least a polyester unit.

(4) A toner according to any one of the above-mentioned items (1) to (3), in which the binder resin contains a hybrid resin obtained by chemically bonding the polyester unit and a vinyl polymer unit.

(5) A toner according to any one of the above-mentioned items (1) to (4), in which heat of formation ΔH1 (J/g) of an endothermic main peak upon temperature increase in a DSC curve of the toner measured with a differential scanning calorimeter and heat of formation ΔH2 (J/g) of an endothermic main peak upon temperature increase in a DSC curve of the THF soluble matter measured with the differential scanning calorimeter when the toner is extracted by Soxhlet extraction for 16 hours satisfy the following relational expression 2:

$$1.5<\Delta H2/\Delta H1<2.5 \quad \text{(Ex. 2).}$$

According to the present invention, there can be provided a toner which: maintains high developability and a high-quality image even in high-speed development and long-term use; is excellent in low-temperature fixability and gloss even in a low-pressure fixing system; and is excellent in transparency at the time of color printing.

Further feature of the present invention will become apparent from the following description of exemplary embodiments with reference to the attached drawings.

DESCRIPTION OF THE EMBODIMENTS

Figure 1:
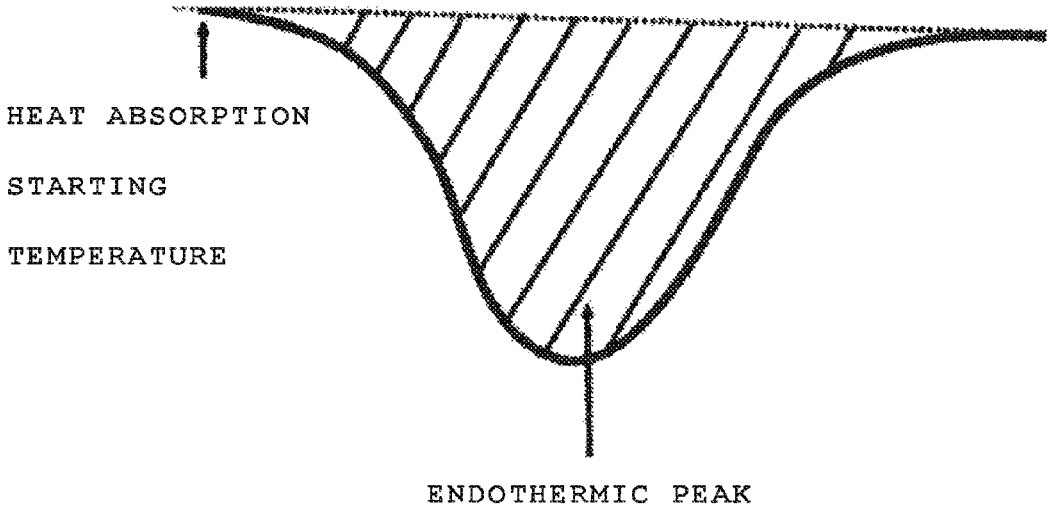
FIG. 1 is a view showing an endothermic peak of a DSC curve.

Hereinafter, the present invention will be described in detail.

The present invention relates to a toner containing at least a binder resin and a colorant, the toner being characterized in that: a square radius of inertia Rt at the peak top of a main peak in the GPC-RALLS-viscometer analysis of THF soluble matter when the toner is dissolved in a THF solvent at 25° C. for 24 hours is 1.0 nm to 3.8 nm; and a ratio Rt/Rp of the square radius of inertia Rt to a square radius of inertia Rp at the peak top of the main peak in the GPC-RALLS-viscometer analysis of THF soluble matter when linear polystyrene having an absolute peak molecular weight value at the same value as the main peak value of the toner is dissolved in a THF solvent at 25° C. for 24 hours is less than 0.85.

A toner having a low melting viscosity has been conventionally used in order that low-temperature fixability may be improved. Examples of a method of reducing the viscosity of a toner typically include a method involving reducing the glass transition point of a polymer and a method involving reducing the molecular weight of the polymer. However, the former method causes a reduction in storage stability, and the latter method has problems such as reductions in hot offset resistance and triboelectric charging property and an increase in possibility that the fusion of the toner to a photosensitive member occurs. In view of the foregoing, in the present invention, a low-molecular weight component is appropriately branched. The branching can achieve low-temperature fixability and high gloss without causing conventional problems such as a decrease in storage stability, the deterioration of offset property, and a decrease in triboelectric chargeability even when the molecular weight of a polymer is reduced. In other words, the appropriate branching of the low-molecular weight component causes not only a main chain but also a side chain to be involved in entanglement with any other raw material, whereby material dispersibility is improved. Further, the low-molecular weight component contributing to fixability is branched, whereby the number of charging points at a terminal of a molecule increases and charging stability with a transfer material upon fixation improves. In addition, the low-molecular weight component is branched, whereby the area of contact between a toner and the transfer material upon fixation increases. As a result, fixing performance improves, and good, high gloss can be achieved even in a low-pressure fixing system.

In addition, the amount of low-molecular weight components each having insufficient dispersibility like conventional ones is reduced, so adverse effects on storage stability and offset resistance are alleviated. As a result, a reduction in molecular weight (i.e., reduction in softening point) can be attained to a degree not heretofore attained. The result leads to an improvement in fixing performance and reduction in a melting viscosity, whereby an improvement in gloss can also be attained to a degree not heretofore attained. Further, the branching of a low-molecular weight component facilitates the control of a molecular weight and a degree of branching, and the optimization of the melting viscosity enables gloss to be controlled in correspondence with a wide fixation temperature range.

In addition, even in the case where a large number of images are outputted in a high-speed developing system, higher priority is placed on the melting of the main chain of a low-molecular weight body than on the melting of any side chain of the body at the initial stage of the image output, that is, when the temperature of a heat roller is high; while higher priority is placed on the melting of any side chain of the body than on the melting of the main chain of the body at the time of completion of the image output, that is, when the temperature of the heat roller is low. As a result, a stable image hardly affected by a change in temperature of the heat roller can be provided.

In the present invention, a GPC-RALLS-viscometer analyzer is used as a device for measuring a square radius of inertia and an absolute molecular weight. The analyzer has three different detectors: a refraction detector, a light scattering detector, and a viscosity detector. The use of the analyzer enables one to determine an absolute molecular weight and a branched state not derived from the molecular size (i.e., square radius of inertia) and a kind of a polymer.

A molecular weight distribution measured with a GPC device that has been conventionally used is a molecular weight distribution converted in terms of a molecular size. Accordingly, the distribution cannot accurately represent a molecular weight intrinsic to, in particular, a branched polymer. There arises a problem in that even polymers having the same molecular weight are different from each other in, for example, low-temperature fixability or offset resistance, with the result that a situation in which toner design is inhibited occurs.

In contrast, the GPC-RALLS-viscometer analyzer can measure the absolute molecular weight of a polymer, so information acquired by using the analyzer matches well with the results of, for example, low-temperature fixability and offset resistance.

In the present invention, a square radius of inertia at the peak top of a main peak is specified because of the following fact found by the inventors: that is, toner performance largely depends on a component whose content in toner is largest among the polymer components in the toner, and the square radius of inertia of the component is directly reflected in the toner performance such as fixability or high gloss property. The fact that the square radius of inertia Rt at the peak top of the main peak is large represents that the toner is controlled by an additionally large polymer. In contrast, the fact that the square radius of inertia Rt is small represents that the toner is controlled by an additionally small polymer.

In addition, comparison between the square radius of inertia Rt and the square radius of inertia Rp at the peak top of the main peak of linear polystyrene having an absolute peak molecular weight value at the same value as the main peak value of the toner shows a ratio of branched polymers to the toner. A lower ratio (Rt/Rp) represents that the toner is controlled more by a branched polymer.

In view of the foregoing, in the present invention, a toner composed of a binder resin containing an appropriately branched low-molecular weight resin component can be specified by specifying values for the square radius of inertia Rt and the ratio Rt/Rp.

In the present invention, GPC-RALLS-viscometer analysis is performed at 40° C., which is a relatively low temperature. Accordingly, the result of the measurement of only a resin component free of any wax component is reflected in the result of the measurement of the square radius of inertia Rt.

In the present invention, the square radius of inertia Rt is preferably 1.0 nm to 3.8 nm, more preferably 1.5 nm to 3.7 nm, still more preferably 1.5 nm to 3.5 nm, or still further more preferably 2.0 nm to 3.5 nm in order that low-temperature fixability and high gloss may be obtained. When the square radius of inertia Rt is less than 1.0 nm, the size of a molecule remarkably reduces, mixing property with any other raw material deteriorates, and storage stability deteriorates. Meanwhile, when the square radius of inertia Rt is more than 3.8 nm, a melting rate upon fixation is lowered, and the feeling of roughness of a fixed image becomes conspicuous particularly in a high-speed developing system, with the result that the uniformity and durable stability of gloss deteriorate.

The ratio Rt/Rp is less than 0.85, and is preferably 0.10 to 0.80, more preferably 0.40 to 0.80, or still more preferably 0.50 to 0.70 in order that the toner performance of the present invention may be obtained. When the ratio is less than 0.10, the toner is controlled by a component having a high degree of branching, so a quantitative balance between a main chain and a side chain is lost, and durable development performance deteriorates in some cases due to the deterioration of mixing property with any other raw material. Meanwhile, when the ratio is 0.85 or more, the toner is controlled by a linear polymer, so the area of contact between the toner and a transfer material reduces upon fixation in some cases. As a result, the toner is fixed to the transfer material, but the adhesive force of the toner to the transfer material is weak, so an image defect may be cause when a stress is applied to the toner after the fixation. Further, the area of contact between the toner and the transfer material reduces upon fixation due to a low degree of branching, with the result that a desired gloss value cannot be obtained in a low-pressure fixing system.

A peak molecular weight Mp according to the GPC-RALLS-viscometer analysis of the THF soluble matter of the toner is preferably 5,000 to 30,000 (more preferably 9,000 to 19,000, or still more preferably 11,000 to 18,000). When the peak molecular weight is less than 5,000, offset resistance deteriorates. When the peak molecular weight is more than 30,000, fixing performance deteriorates and desired gloss cannot be obtained.

Further, a ratio of molecules each having a square radius of inertia of 5 nm or less to the entire peak area is preferably 60.0 to 100.0 mass %. The range is one of the indications representing the molecular size of the entire toner, and serves as an important indication in obtaining the high gloss of the toner. It is desirable that the ratio of molecules each having a square radius of inertia of 5 nm or less be 60.0 to 100.0 mass %, preferably 62.0 to 100.0 mass %, or more preferably 65.0 to 100.0 mass %. When the ratio is less than 60.0 mass %, the entire toner is controlled by a large molecule or polymer component, so a melting viscosity increases and a desired gloss value cannot be obtained.

In addition, a square radius of inertia Rgw of the entire peak is preferably 15.0 nm or less (more preferably 13.0 nm or less, or still more preferably 12.0 nm or less). When the square radius of inertia is 15.0 nm or more, the molecular size of the entire toner is enlarged, so the uniformity and durable stability of gloss deteriorate as in the above-mentioned case where the square radius of inertia Rt is large.

Further, a ratio of molecules each having a molecular weight of 20,000 or less to the entire peak is preferably 20.0 to 90.0 mass % (more preferably 30.0 to 80.0 mass %, or still more preferably 35.0 to 70.0 mass %). When the ratio is less than 20.0 mass %, the amount of a low-molecular weight component is small, so the melting viscosity of the toner increases, fixability deteriorates, and it becomes difficult to improve gloss. When the ratio is more than 90.0 mass %, offset resistance deteriorates.

In addition, an intrinsic viscosity IVw obtained from a viscosity detector is preferably 0.01 to 0.60 dl/g (more preferably 0.15 to 0.40 dl/g, or still more preferably 0.15 to 0.30 dl/g). When the intrinsic viscosity IVw is less than 0.01 dl/g, offset performance deteriorates. When the intrinsic viscosity IVw is more than 0.60 dl/g, it becomes difficult to obtain in high gloss.

The toner of the present invention has a glass transition temperature (Tg) of preferably 40 to 70° C. (more preferably 45 to 65° C., or still more preferably 50 to 60° C.) When the glass transition temperature Tg is lower than 40° C., blocking resistance is apt to deteriorate. When the glass transition temperature Tg exceeds 70° C., fixability is apt to deteriorate.

In addition, the toner has a softening point (Tm) of preferably 90.0 to 140.0° C. (more preferably 95 to 130° C., or still more preferably 95 to 125° C.) from the viewpoint of compatibility among fixability, an improvement in gloss, and offset resistance.

The binder resin to be used in the present invention desirably contains at least a polyester unit. In general, the binder resin is preferably a hybrid resin obtained by chemically bonding a polyester unit excellent in low-temperature fixability and a vinyl polymer unit excellent in hot offset resistance and having high compatibility with a release agent, because a desired branched structure can be easily produced.

A mixing ratio of the polyester unit to the vinyl polymer unit in mass ratio is preferably 50/50 to 90/10 because of the following reason: when the amount of the polyester unit is larger than 50 mass %, required low-temperature fixability can be easily obtained, while, when the amount of the polyester unit is larger than 90 mass %, storage stability is apt to deteriorate and it becomes difficult to control the dispersed state of the release agent.

Although such resin as described above may be used alone as the binder resin, it is preferable to use two or more kinds of binder resins having different softening points, specifically, a low-molecular weight resin and a high-molecular weight resin as a mixture. In order that each of the values for the square radius of inertia Rt and the ratio Rt/Rp may fall within the range specified in the present invention, it is desirable to control the peak molecular weight, square radius of inertia at a peak top, and ratio of the square radius of inertia to the square radius of inertia of linear polystyrene of, in particular, the low-molecular weight resin among the two or more kinds of binder resins.

The low-molecular weight resin has a peak molecular weight MpL according to the GPC-FALLS-viscometer analysis of tetrahydrofuran (THF) soluble matter of preferably 5,000 to 20,000 (more preferably 9,000 to 18,000, or still more preferably 10,000 to 16,500), a square radius of inertia RgL at a peak top of preferably 1.0 to 5.0 nm (more preferably 2.0 to 4.0 nm, or still more preferably 2.5 to 3.5 nm), and a ratio RgL/Rgp of the square radius of inertia RgL to a square radius of inertia Rgp at a peak top in linear polystyrene having an absolute peak molecular weight value at the same value as the above-mentioned peak molecular weight value, of 0.30 to 0.95 (more preferably 0.40 to 0.90, or still more preferably 0.50 to 0.80) in order that a balance among gloss, storage stability, and fixation offset property may be established. In addition, molecular weight control is important for obtaining the low-molecular weight resin. The low-molecular weight resin has a ratio of molecules each having a molecular weight of 20,000 or less to the entire peak of preferably 60.0 to 100.0 mass % (more preferably 75.0 to 100.0 mass %, still more preferably 80.0 to 100.0 mass %, or still further more preferably 85.0 to 100.0 mass %). When the ratio of molecules each having a molecular weight of 20,000 or less to the entire peak is less than 60.0 mass %, desired gloss cannot be obtained.

In addition, the low-molecular weight resin has a square radius of inertia RgwL in the entire peak of preferably 2.0 to 6.0 nm (more preferably 3.0 to 5.0 nm, or still more preferably 3.0 to 4.0 nm) and a ratio of molecules each having a square radius of inertia of 5 nm or less to the entire peak of preferably 70.0 to 100.0 mass % (more preferably 80.0 to 100.0 mass %, or still more preferably 82.0 to 100.0 mass %) form the viewpoint of mixing property with the high-molecular weight resin.

In addition, the low-molecular weight resin has an intrinsic viscosity IVwL obtained from a viscosity detector of preferably 0.10 to 0.18 dl/g (more preferably 0.10 to 0.16 dl/g). When the intrinsic viscosity IVwL is less than 0.10 dl/g, offset performance deteriorates. When the intrinsic viscosity IVwL is more than 0.18 dl/g, it becomes difficult to obtain high gloss.

In addition, the softening point of the low-molecular weight resin measured by using a flow tester is preferably 80.0 to 105.0° C., or more preferably 90.0° C. to 100.0° C. in order that a balance among fixability, gloss control, and offset resistance may be established.

In addition, the glass transition temperature of the low-molecular weight resin is preferably 45.0 to 60.0° C., or more preferably 45.0 to 58.0° C. from the viewpoints of fixability and storage stability.

In addition, the low-molecular weight resin has an acid value of preferably 10 to 50 mgKOH/g, or more preferably 20 to 40 mgKOH/g, and a hydroxyl value of preferably 40 to 70 mgKOH/g, or more preferably 50 to 65 mgKOH/g in order that a branched polymer may be formed and desired performance such as gloss may be obtained.

The high-molecular weight resin has a peak molecular weight MpH according to the GPC-RALLS-viscometer analysis of THF soluble matter of preferably 10,000 to 40,000, a square radius of inertia RgH at a peak top of preferably 3.0 to 7.0 nm, and a ratio RgH/Rgp of the square radius of inertia RgH to a square radius of inertia Rgp at a peak top in linear polystyrene having an absolute peak molecular weight value at the same value as the above-mentioned peak molecular weight value of 0.30 to 0.95. In addition, the high-molecular weight resin has a ratio of molecules each having molecular weight of 20,000 or less to the entire peak of preferably 0.0 to 50.0 mass % (more preferably 10.0 to 40.0 mass %, or still more preferably 20.0 to 40.0 mass %) for improving mixing property with the low-molecular weight resin.

In addition, the high-molecular weight resin has a square radius of inertia RgwH in the entire peak of preferably 5.0 to 15.0 nm (more preferably 7.0 to 13.0 nm) and a ratio of molecules each having a square radius of inertia of 5 nm or less to the entire peak of preferably 0.0 to 50.0 mass % (more preferably 30.0 to 50.0 mass %) from the viewpoint of mixing property with the low-molecular weight resin.

In addition, the high-molecular weight resin has an intrinsic viscosity IVwH obtained from a viscosity detector of preferably 0.20 to 0.70 dl/g (more preferably 0.30 to 0.50 dl/g). When the intrinsic viscosity IVwH is less than 0.20 dl/g, offset performance deteriorates, or storage stability deteriorates. Meanwhile, when the intrinsic viscosity IVwH is more than 0.70 dl/g, fixability deteriorates.

Further, the softening point of the high-molecular weight resin measured by using a flow tester is preferably 110 to 150° C., or more preferably 120 to 140° C. for improving the mixing property with the low-molecular weight resin.

In addition, the glass transition temperature of the high-molecular weight resin is preferably 45 to 65° C., or more preferably 45 to 60° C. from the viewpoints of fixability and storage stability.

In addition, the high-molecular weight resin has an acid value of preferably 10 to 40 mgKOH/g, or more preferably 10 to 30 mgKOH/g, and a hydroxyl value of preferably 10 to 40 mgKOH/g, or more preferably 20 to 40 mgKOH/g from the viewpoints of the stabilization of chargeability and the maintenance of offset resistance.

When those two kinds of resins are used as a mixture, a ratio between the low-molecular weight resin and the high-molecular weight resin is preferably 100:0 to 20:80 in mass ratio from the viewpoints of gloss control, offset property, and polymer mixing property.

Hereinafter, a monomer for use in the polyester unit in the binder resin to be used in the present invention will be described. An alcohol which is dihydric or trihydric or more, and a carboxylic acid which is divalent or trivalent or more, or an acid anhydride or lower alkyl ester of the carboxylic acid are used as raw material monomers for polyester. Here, when a branched polymer is produced, it is effective to perform partial crosslinking in a molecule of the binder resin. The use of a polyfunctional compound which is trivalent or more achieves the partial crosslinking. Therefore, in the present invention, at least one of: a carboxylic acid which is trivalent or more, or an acid anhydride or lower alkyl ester of the carboxylic acid; and an alcohol which is trihydric or more is preferably incorporated as a raw material monomer.

Examples of the dihydric carboxylic acid component include: maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid; and anhydrides, lower alkyl esters, or the like of those acids. Of those, maleic acid, fumaric acid, terephthalic acid, and n-dodecenylsuccinic acid are preferably used.

Examples of the carboxylic acid having the valence of three or more, the acid anhydride, or the lower alkyl ester thereof include: 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, empole trimer acid; and acid anhydrides, lower alkyl esters, or the like thereof. Of those, in particular, 1,2,4-benzenetricarboxylic acid, that is, trimellitic acid or derivatives thereof are preferably used because those are inexpensive and their reactions can be easily controlled.

In the present invention, one of the dihydric carboxylic acid, the carboxylic acid having the valence of three or more, and the like may be used alone or two or more kinds thereof may be used in combination.

Examples of the dihydric alcohol component include: alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A.

Of those, alkylene oxide adducts of bisphenol A, ethylene glycol, 1,2-propylene glycol, 1,3-propylene glycol, and neopentyl glycol are preferably used. In particular, ethylene glycol is preferably because it enhances a sharp melt property of a resin.

Examples of the alcohol component having three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzne. Of those, glycerol, trimethylolpropane, and pentaerythritol are preferably used.

In the present invention, one of the dihydric alcohol and alcohol having three or more hydroxyl groups may be used alone or two or more kinds thereof may be used in combination.

Examples of the catalyst include a catalyst generally used for polyesteration, for example: metals such as tin, titanium, antimony, manganese, nickel, zinc, lead, iron, magnesium, calcium, and gemianium; and compounds containing those metals such as dibutyl tin oxide, dibutyl orthotitanate, tetrabutyl titanate, zinc acetate, lead acetate, cobalt acetate, sodium acetate, and antimony trioxide.

Examples of the vinyl monomer to be used for producing a vinyl polymer unit to be used for a binder resin according to the present invention include the following styrene monomers and acrylate monomers.

Examples of the styrene monomer include: styrenes such as styrene, o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; and derivatives thereof.

Examples of the acrylate monomer include: acrylic acids and acrylic esters such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; α-methylene aliphatic monocarboxylic acids and esters thereof such as methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and acrylate or methacrylate derivatives such as acrylonitrile, methacrylonitrile, and acrylamide.

Further, examples of the monomer of a vinyl polymer unit include: acrylate esters or methacrylate esters such as 2-hydroxylethyl acrylate, 2-hydroxylethyl methacrylate, and 2-hydroxylpropyl methacrylate; and monomers each having a hydroxyl group such as 4-(1-hydroxy-1-methylbutyl) styrene and 4-(1-hydroxy-1-methylhexyl) styrene.

In the vinyl polymer unit, if required, it is possible to use in combination with various monomers each capable of vinyl polymerization. Examples of such monomers include: ethylenically unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and further, unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated basic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated basic acid esters such as dimethyl maleate and dimethyl fumarate; acid anhydrides of α,β-unsaturated acids such as acrylic acid, methacrylic acid, crotonic acid, and cinnamic acid; anhydrides of the above-mentioned, α,β-unsaturated acids and lower aliphatic acids; and monomers each having a carboxyl group such as alkenylmalonic acid, alkenylglutaric acid, and alkenyladapic acid, and acid anhydrides thereof and monoesters thereof.

In addition, the vinyl polymer unit may be a polymer crosslinked by a crosslinkable monomer as exemplified below as required. Examples of the crosslinkable monomer include: aromatic divinyl compounds; diacrylate compounds connected by alkyl chains; diacrylate compounds connected by alkyl chains each containing an ether bond; diacrylate compounds connected by chains each containing an aromatic group and an ether bond; polyester type diacrylates; and polyfunctional crosslinking agents.

Examples of the aromatic divinyl compound include divinyl benzene and divinyl naphthalene.

Examples of the diacrylate compounds connected by alkyl chains include: ethylene glycol diacrylate, 1,3-butylene glycol diacrylate, 1,4-butandeiol diacrylate, 1,5-pentanediol diacrylate, 1,6-hexanediol diacrylate, neopentyl glycol diacrylate, and those obtained by changing the "acrylate" of the above-mentioned compounds to "methacrylate".

Examples of the diacrylate compounds connected by alkyl chains each containing an ether bond include: diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the "acrylate" of the above-mentioned compounds to "methacrylate".

Examples of the diacrylate compounds connected by chains each containing an aromatic group and an ether bond include: polyoxyethylene(2)-2,2-bis(4-hydroxyphenyl)propane diacrylate and polyoxyethylene(4)-2,2-bis(4-hydroxyphenyl)propane diacrylate; and those obtained by changing the "acrylate" of the above-mentioned compounds to "methacrylate". An example of the polyester type diacrylates includes MANDA, trade name, manufactured by Nippon Kayaku Co., Ltd.

Example of the polyfunctional crosslinking agents include: pentaerythritol triacrylate, trimethylolethane triacrylate, trimethylolpropane triacrylate, tetramethylolmethane tetraacrylate, and oligoester acrylate; those obtained by changing the "acrylate" of the above-mentioned compounds to "methacrylate"; triallyl cyanurate; and triallyl trimellitate.

Each of those crosslinkable monomers can be used in an amount of preferably 0.01 to 10 mass % (or more preferably 0.03 to 5 mass %) with respect to 100 mass % of the other monomer components. In addition, examples of a monomer to be suitably used in terms of fixability and offset resistance out of those crosslinkable monomers include aromatic divinyl compounds (in particular, divinylbenzene) and diacrylate compounds connected by chains each containing an aromatic group and an ether bond.

The vinyl polymer unit may be a resin produced by using any one of polymerization initiators. Each of those initiators is preferably used in an amount of 0.05 to 10 parts by mass with respect to 100 parts by mass of the monomer in terms of efficiency.

Examples of such polymerization initiators include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, a,a'-bis(t-butylperoxyisopropyl) benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

A hybrid resin to be more preferably used as the binder resin in the present invention is a resin in which the polyester unit and the vinyl polymer unit are chemically bound to each other directly or indirectly.

Therefore, polymerization is performed by using a compound capable of reacting with the monomers of both resins (hereinafter referred to as "bireactive compound"). Examples of such bireactive compound include compounds such as fumaric acid, acrylic acid, methacrylic acid, citraconic acid, maleic acid, and dimethyl fumarate in the monomers of the condensation polymerization resin and the monomers of the addition polymerization resin described above. Of those, fumaric acid, acrylic acid, and methacrylic acid are preferably used.

The amount of the bireactive compound to be used is 0.1 to 20 wt %, or preferably 0.2 to 10 wt % in all raw material monomers.

The hybrid resin can be obtained by causing the raw material monomers for the polyester unit and the raw material monomers for the vinyl polymer unit to react with each other simultaneously or sequentially. A preferable method in the present invention involves: subjecting a vinyl polymerizable monomer or an unsaturated polyester resin to an addition polymerization reaction; and subjecting the raw material monomers for the polyester unit to a condensation polymerization reaction after the addition polymerization reaction. A particularly preferable form in the production of the branched low-molecular weight polymer of the present invention is as follows: the condensation polymerization reaction is performed at two temperature stages, and a crosslinking monomer is added in the midstream of the reaction.

Addition polymerization is performed first for the purpose of obtaining a main chain having a desired low molecular weight. The control of the molecular weight of the main chain facilitates the obtainment of desired gloss. Next, in the first step of condensation polymerization, a monomer as a side chain is polymerized with a polymer as the main chain, whereby a branched polymer is produced. At this stage, a polymer having some degree of branching can be produced. Further, in the second step of the condensation polymerization, a condensation polymerization reaction is performed at an additionally high temperature, whereby a uniform branched polymer with an additionally increased degree of branching is produced. A low-molecular weight polymer excellent in mixing property with any other raw material cannot be produced until this stage. A toner having a low-molecular weight resin produced by a production method that does not include a second stage has poor mixing property with a release agent or the like. The poor mixing property leads to poor uniformity of gloss in a high-speed developing system, or to the deterioration of durable developability due to the deterioration of the dispersion of a raw material.

In addition, in the toner of the present invention, a relationship between heat of formation ΔH1 (J/g) of an endothermic main peak upon temperature increase in the DSC curve of the toner measured with a differential scanning calorimeter and heat of formation ΔH2 (J/g) of an endothermic main peak upon temperature increase in the DSC curve of THF soluble matter measured with a differential scanning calorimeter when the toner is extracted by Soxhlet extraction for 16 hours preferably satisfy the following relational expression 2:

$$1.5<\Delta H2/\Delta H1<2.5 \quad \text{(Ex. 2).}$$

The heat of formation ΔH1 and the heat of formation ΔH2 more preferably satisfy the relationship of $1.6<\Delta H2/\Delta H1<2.4$, or still more preferably satisfy the relationship $1.8<\Delta H2/\Delta H1<2.4$.

Such toner is preferable because it is excellent in property with which the bonding of discharged paper is suppressed and in cleaning property, and because it can provide a stable image even when a large number of images are continuously printed.

That is, the inventors of the present invention have found that the excellent dispersed state of a release agent in the toner can be obtained by controlling the square radius of inertia, in other words, molecular size of a binder resin (polymer) component present in the toner and a ratio between the heat of formation of the release agent present in the toner in the presence of Soxhlet extraction and the heat of formation of the release agent in the absence of Soxhlet extraction. In other words, the states of presence of the release agent in and on the surface of the toner can be optimized by controlling, at a molecular level, the state where the release agent is taken into a polymer having a specific molecular size. As a result, it has become possible to: improve property with which the bonding of discharge paper is suppressed and cleaning property significantly; and produce a toner capable of providing a stable image when a large number of images are continuously printed.

In ordinary cases, a method such as the addition of a dispersing agent is employed for improving the dispersibility of a release agent in toner. However, a polymer having a specific molecular size is used in the present invention. The use of the polymer has reduced a difference in molecular site between the polymer and a release agent as compared to a difference in molecular size between a conventional polymer and the release agent to make it possible to improve compatibility between the polymer and the release agent. As a result, it has become possible to obtain a toner excellent in dispersibility of the release agent.

The fact that the ratio ΔH2/ΔH1 is large means that the release agent is brought into a state where it is easily eluted when heat is applied. In contrast, the fact that the ratio ΔH2/ΔH1 is small means that the release agent is hardly eluted even when heat is applied.

When extraction is performed by applying heat, there is a correlation between the ease with which the release agent is eluted and whether the dispersibility of the release agent is good or bad. In other words, when the dispersibility of the release agent is good, the molecular motions of the release agent with the resin polymer having a small molecular size peculiar to the present invention occur in synchronization with each other. As a result, heat is uniformly transferred to the entire release agent with ease, and the release agent is brought into a state where it is easily eluted. On the other hand, in the case where the release agent is unevenly distributed, when heat is transferred to the resin polymer part and the entire release agent part, a difference in thermal conductivity between the parts makes it difficult to cause a chain of molecular motions, with the result that the rate at which heat is transferred reduces.

In addition, in the case of a polymer having a relatively large square radius of inertia (i.e., a wide expansion of molecules) like a conventional one, the elution of a release agent from the inside of toner is inhibited by the expanded polymer, so the release agent is hardly eluted. In contrast, a polymer having a small expansion of molecules like the polymer of the present invention does not inhibit the elution of a release agent from the inside of toner, so the ease with which the release agent is eluted to the surface of the toner upon fixation is improved.

In other words, the creation of the dispersed state of a release agent satisfying the relationship of $1.5<\Delta H2/\Delta H1<2.5$ increases the rate at which heat is transferred. In particular, when toner is at high temperature while being pressurized by a fixing roller, the creation can increase the amount or the release agent in the toner to exude to the fixing surface of the toner, so the releasing effect of the release agent can be sufficiently exerted on the surface of the toner.

In addition, a conventional technique has involved the following problem: when a transfer material is passed through a heat roller upon fixation, density unevenness may occur owing to a difference in temperature between the leading end and rear end of the transfer material. In contrast, in the toner of the present invention, the release agent component and the resin component are evenly distributed, so the toner shows excellent sharp meltability, and a uniform fixing surface can be obtained irrespective of some degree of difference in temperature between the leading end and rear end of a transfer material upon fixation.

As described above, even in a state where neither heat nor pressure is applied, the dispersion uniformity of the release agent present in a state of being exposed to the surface of the toner improves in proportion to a drastic improvement in dispersibility of the release agent in the toner. In other words, electrical repulsion between the release agent and the resin in the toner occurs at the surface of the toner similarly, so the dispersion of the release agent at the surface is also expected to be uniform.

In addition, friction between the toner and a cleaning blade is optimally adjusted as a result of the control of the uniformity of the release agent at the surface of the toner to a proper value, in other words, such control that the relationship of $1.5<\Delta H2/\Delta H1<2.5$ is satisfied. As a result, good cleaning property is exerted even in a severe use situation such as the continuous printing of a large number of images. In other words, good cleaning stability can be obtained, which prevents the occurrence of, for example, the fusion of the toner to a drum resulting from the chipping of the cleaning blade occurring when friction between the blade and the toner is excessively large or from a cleaning failure caused by the leak of the toner out of the blade when friction between them is excessively small.

In addition, the toner of the present invention can obtain appropriate frictional property (i.e., sliding property) peculiar to the release agent even when neither heat nor pressure is applied. A system such as an Si drum having small friction with a cleaning blade typically requires a system that intentionally enlarges the friction (i.e., applies large friction) such as a mechanism via which a friction imparting agent is uniformly mounted on a drum like an magnetic roller. However, the optimization of the frictional property of toner itself like the present invention can obtain desired frictional property and provide a toner having superiority over a conventional one in cleaning property, whereby such cleaning mechanism can be omitted.

Further, the deterioration of toner performance due to moisture absorption can be prevented because the release agent is in a state of being exposed to the surface of the toner so that the hygroscopicity of the toner can be reduced.

The toner of the present invention can contain a release agent having a melting point specified by the temperature at which an endothermic peak is present upon temperature increase measured by using a differential scanning calorimeter (DSC) of 60 to 120° C. The melting point of the release agent is preferably 70 to 115° C. When the melting point is lower than 60° C. the viscosity of the toner reduces, a releasing effect reduces, and the contamination of a developing member or of a cleaning member due to duration occurs. When the melting point is higher than 120° C., required low-temperature fixability is hardly obtained.

The amount of the release agent to be added is preferably 1 to 20 parts by mass with respect to 100 parts by mass of the binder resin. When the amount is less than 1 part by mass, a desired releasing effect cannot be sufficiently obtained. When the amount exceeds 20 parts by mass, the dispersibility of the release agent in the toner is poor, and the adhesion of the toner to a photosensitive member, the contamination of the surface of a developing member or of a cleaning member, or the like occurs, with the result that a problem such as the deterioration of a toner image is apt to occur.

Examples of the release agent include: aliphatic hydrocarbon release agents such as low-molecular weight polyethylene, low-molecular weight polypropylene, a microcrystalline release agent, and a paraffin release agent; oxides of aliphatic hydrocarbon release agents such as a polyethylene oxide release agent; block copolymers of the aliphatic hydrocarbon release agents; release agents mainly composed of fatty acid esters such as a carnauba wax, a sasol release agent, and a montanic acid ester release agent; and partially or wholly deacidified fatty acid esters such as a deacidified carnauba release agent. The examples further include: saturated straight-chain fatty acids such as palmitic acid, stearic acid, montanic acid, and long-chain alkyl carboxylic acids each having an additionally long alkyl chain; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, melissyl alcohol, or long-chain alkyl alcohols each having an additionally long alkyl chain; polyhydric alcohols such as sorbitol; aliphatic metal salts (what are generally referred to as metallic soaps) such as calcium stearate, calcium laurate, zinc stearate, and magnesium stearate; release agents obtained by grafting aliphatic hydrocarbon release agents with vinyl monomers such as styrene and acrylic acid; partially esterified compounds of fatty acids and polyhydric alcohols such as behenic monoglyceride; methyl ester compounds each having a hydroxyl group obtained by the hydrogenation of vegetable oil; and long-chain alkyl alcohols or long-chain alkyl carboxylic acids each having 12 or more carbon atoms.

Examples of a release agent to be particularly preferably used in that present invention include aliphatic hydrocarbon release agents. The examples of such aliphatic hydrocarbon release agents include: a low-molecular weight alkylene polymer obtained by subjecting an alkylene to radical polymerization under high pressure or by polymerizing an alkylene under reduced pressure by using a Ziegler catalyst; an alkylene polymer obtained by thermal decomposition of a high-molecular weight alkylene polymer; a synthetic hydrocarbon release agent obtained from a residue on distillation of a hydrocarbon obtained by means of an Age method from a synthetic gas containing carbon monoxide and hydrogen, and a synthetic hydrocarbon release agent obtained by hydrogenation of the gas; and those obtained by fractionating those aliphatic hydrocarbon release agents by means of a press sweating method, a solvent method, or vacuum distillation or according to a fractional crystallization mode.

Examples of a hydrocarbon as a parent body of each of the above-mentioned aliphatic hydrocarbon release agents include: one synthesized by a reaction between carbon monoxide and hydrogen using a metal oxide catalyst (a multiple system composed of two or more kinds in many cases (such as a hydrocarbon compound synthesized by means of a synthol method or a hydrocol method (involving the use of a fluid catalyst bed)); a hydrocarbon having several hundred of carbon atoms obtained by means of an Age method (involving the use of an identification catalyst bed) with which a large amount of release agent-like hydrocarbon can be obtained; and a hydrocarbon obtained by polymerizing an alkylene such as ethylene by using a Ziegler catalyst. Of such hydrocarbons, in the present invention, a small, saturated, and long straight-chain hydrocarbon with a small number of branches is preferable, and a hydrocarbon synthesized by means of a method not involving the polymerization of an alkylene is particularly preferable because of its molecular weight distribution.

Specific examples of a release agent that can be used include: Biscol (trademark) 330-P, 550-P, 660-P, and TS-200 (Sanyo Chemical Industries, Ltd.); Hi release agent 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (NIPPON SEIRO CO., LTD); Unilin (trademark) 350, 425, 550, and 700, Unisid (trademark) 350, 425, 550, and 700 (TOYO-PETROLITE); and a haze wax, a beeswax, a rice wax, a candelilla wax, and a carnauba wax (available from CERARICA NODA Co., Ltd.).

The time at which the release agent is added is appropriately selected from the existing methods. For example, the release agent may be added at the time of melting and kneading during toner production, or may be added at the time of production of the binder resin. In addition, one kind of those release agents may be used alone, or two or more kinds of them may be used in combination.

The toner of the present invention may be a magnetic toner or a non-magnetic toner; provided that the toner of the present invention is preferably a magnetic toner in terms of, for example, durability in a high-speed machine.

Examples of the magnetic material to be used in the present invention include: magnetic iron oxides containing iron oxides such as magnetite, maghemite, and ferrite and other metal oxides; metals such as Fe, Co, and Ni, or alloys thereof with metals such as Al, Co, Pb, Mg, Ni, Sn, Zn, Sb, Be, Bf, Cd, Ca, Mn, Se, Ti, W, and V; and mixtures thereof. Conventionally, triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($Cd_3Fe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), and the like have been known. Particularly preferable magnetic material is fine powder of triion tetraoxide or $\gamma$-iron sesquioxide. Furthermore, each of the magnetic materials mentioned above can be selected and used alone, or two or more kinds thereof can be selected and used in combination.

Each of those magnetic materials preferably has magnetic properties in an applied magnetic field of 795.8 kA/m including: a coercive force Hc of 1.6 to 12.0 kA/m; a saturation magnetization $\sigma s$ of 50 to 200 $Am^2/kg$ (more preferably 50 to 100 $Am^2/kg$); and a residual magnetization or of 2 to 20 $Am^2/kg$. The magnetic properties of a magnetic material in an external magnetic field of 795.8 kA/m at 25° C. can be measured by using an oscillation sample type magnetometer such as a VSM P-1-10 (manufactured by Toei Industry Co., Ltd.).

The amount of the magnetic material to be added is preferably 10 to 200 parts by mass with respect to 100 parts by mass of the binder resin.

In addition, carbon black or at least one kind of the other conventionally known various pigments and dyes can be used as the colorant to be contained in the toner of the present invention.

Examples of the dye include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Example of the pigment include Chrome Yellow, Cadmium Yellow, Mineral Fast Yellow, Navel Yellow, Naphthol Yellow S, Hansa Yellow G, Permanent Yellow NCG, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salt, Eosine Lake, Brilliant Carmine 3B, Manganese Purple, Fast Violet B, Methyl Violet Lake, Prussian Blue, Cobalt Blue, Alkali Blue Lake, Victoria Blue Lake, Phthalocyanine Blue, Fast Sky Blue, Indanthrene Blue BC, Chrome Green, Chrome Oxide, Pigment Green B, Malachite Green Lake, and Final Yellow Green G.

When the toner of the present invention is used for full color image-forming toner, the following colorants can be used. Examples of coloring pigments for magenta include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C.I. Pigment Violet 19; and C.I. Vat Red 1, 2, 10, 13, 15, 23, 29, and 35.

Each of the magenta pigments may be used alone. However, it is more preferable to combine the dye and the pigment to improve definition of an image, from the viewpoint of image quality of a full color image. Examples of the dye for magenta include: oil soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40 and C.I. Basic Violet 1, 3, 7, 10, 14, 15, 21, 25, 26, 27, and 28.

Examples of the coloring pigment for cyan include: C.I. Pigment Blue 2, 3, 15, 16, and 17; C.I. Vat Blue 6; C.I. Acid Blue 45; and a copper phthalocyanine pigment in which a phthalocyanine skeleton having the following structure is substituted by 1 to 5 phthalimidemethyl groups.

[Chem 1]

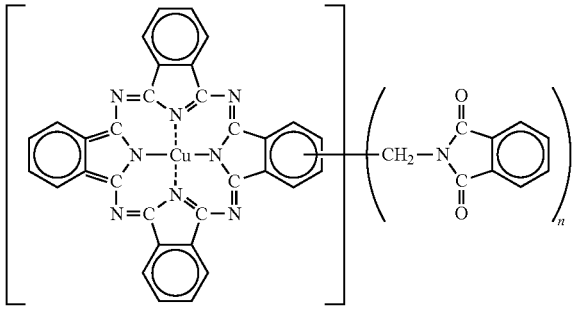

n = 1 ~ 5

Examples of the coloring pigment for yellow include: C.I. Pigment Yellow 1, 2, 3, 4, 5, 6, 7, 10, 11, 12, 13, 14, 15, 16, 17, 23, 35, 73, and 83; and C.I. Vat yellow 1, 3, and 20.

The content of the colorant is preferably 0.1 to 60 parts by mass, or more preferably 0.5 to 50 parts by mass with respect to 100 parts by mass of the content of the binder resin.

A charge control agent can be used in the toner of the present invention to stabilize the chargeability of the toner. A charge control agent is generally incorporated into toner particles in an amount of preferably 0.1 to 10 parts by mass, or more preferably 0.1 to 5 parts by mass with respect to 100 parts by mass of the binder resin, although the amount varies depending on, for example, the kind of the charge control agent and the physical properties of other materials constituting the toner particles. Known examples of such charge control agent include one for controlling toner to be negatively chargeable and one for controlling toner to be positively chargeable. At least one kind of various charge control agents can be used depending on the kind and applications of the toner.

For example, an organometallic complex or a chelate compound is an effective charge control agent for controlling toner to be negatively chargeable. Examples of such charge control agent for controlling toner to be negatively chargeable include: monoazo metal complexes; acetylacetone metal complexes; metal complexes or metal salts of aromatic hydroxycarboxylic acids or aromatic dicarboxylic acids. The examples of such charge control agent for controlling toner to be negatively chargeable further include: aromatic monocarboxylic and polycarboxylic acids, and metal salts and anhydrates of the acids; esters; and phenol derivatives such as bisphenol.

Examples of a charge control agent for controlling toner to be positively chargeable include: nigrosin and denatured products of nigrosin with aliphatic metal salts, and the like; quaternary ammonium salts such as tributylbenzyl ammonium-1-hydroxy-4-naphtosulfonate and tetrabutyl ammonium tetrafluoroborate, and analogs of the salts, which are onium salts such as phosphonium salts and lake pigments of the salts; triphenyl methane dyes and lake pigments of the dyes (lake agents include phosphotungstic acid, phosphomolybdic acid, phosphotungsten molybdic acid, tannic acid, lauric acid, gallic acid, ferricyanic acid, and ferrocyanide); metal salts of higher aliphatic acids; diorganotin oxides such as dibutyltin oxide, dioctyltin oxide, and dicyclohexyltin oxide; and diorganotin borates such as dibutyltin borate, dioctyltin borate, and dicyclohexyltin borate. In the present invention, one kind of them may be used alone, or two or more kinds of them may be used in combination. Of those, a charge control agent for controlling toner to be positively chargeable made of a nigrosin compound, a quaternary ammonium salt, or the like is particularly preferably used.

Specific examples of a charge control agent that can be used include: Spilon Black TRH, T-77, and T-95 (Hodogaya Chemical Co., Ltd.); and BONTRON (trademark) S-34, S-44, S-54, E-84, E-88, and E-89 (Orient Chemical Industries, LTD.). Preferable examples of a charge control agent for positive charging include: TP-302 and TP-415 (Hodogaya Chemical Co., Ltd.); BONTRON (trademark) N-01, N-04, N-07, and P-51 (Orient Chemical Industries, LTD.); and Copy Blue PR (Clariant).

A charge control resin can also be used, and can be used in combination with any one of the above-mentioned charge control agents.

The chargeability of the toner of the present invention may be either positive or negative; provided that the toner of the present invention is preferably a negatively chargeable toner because a polyester resin itself serving as the binder resin has high negative chargeability.

An inorganic fine powder may be used as a fluidity improver in the toner of the present invention. Any improver can be used as the fluidity improver as long as the improver can improve fluidity as compared to that before external addition to toner particles. Examples of such fluidity improver include: a fluorine resin powder such as a vinylidene fluoride fine powder or a polytetrafluoroethylene fine powder; fine powdered silica such as silica obtained through a wet process or silica obtained through a dry process; and treated silica obtained by treating the surface of any one of the above-mentioned silicas with a silane coupling agent, a titanium coupling agent, silicone oil, or the like. A preferable fluidity improver is a fine powder produced through the vapor phase oxidation of a silicon halide compound, the fine powder being called dry process silica or fumed silica. That is, the dry process silica or fumed silica is produced by means of a conventionally known technique. For example, the production utilizes a thermal decomposition oxidation reaction in oxygen and hydrogen of a silicon tetrachloride gas, and a basic reaction formula for the reaction is represented by the following formula:

$$SiCl_4+2H_2+O_2 \rightarrow SiO_2+4HCl$$

A composite fine powder of silica and any other metal oxide can also be obtained by using a silicon halide compound with any other metal halide compound such as aluminum chloride or titanium chloride in the production step, and silica comprehends the composite fine powder as well. A silica fine powder having an average primary particle size in the range of preferably 0.001 to 2 μm, or particularly preferably 0.002 to 0.2 μm is desirably used.

Examples of a commercially available silica fine powder produced through the vapor phase oxidation of a silicon halide compound include those commercially available under the following trade names.

That is: AEROSiL (NIPPON AEROSIL Co., Ltd.) 130, 200, 300, 380, TT600, MOX170, MOX80, COK84; Ca-O-SiL (CABOT Co.) M-5, MS-7, MS-75, HS-5, EH-5; Wacker HDK N 20 (WACKER-CHEMIE GNBH), V15, N20E, T30, T40; D-CFine Silica (DOW CORNING Co.); and Fransol (Francil)

Furthermore, a treated silica fine powder obtained by subjecting the silica fine powder produced through the vapor phase oxidation of a silicon halide compound to a hydrophobic treatment is preferably used. The treated silica fine powder is particularly preferably obtained by treating the silica fine powder in such a manner that the degree of hydrophobicity titrated by a methanol titration test shows a value in the range of 30 to 80.

Hydrophobicity is imparted by chemically treating the silica fine powder with, for example, an organic silicon compound that reacts with, or physically adsorbs to, the silica fine powder. A preferable method involves treating the silica fine powder produced through the vapor phase oxidation of a silicon halide compound with an organic silicon compound. Examples of such organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldiemthoxysilane, diphenyldiethoxysilane, 1-hexamethyldisiloxane, 1,3-divinyltetramethyldisiloxane, 1,3-diphenyltetramethyldisiloxane, and dimethylpolysiloxane which has 2 to 12 siloxane units per molecule and contains a hydroxyl group bound to Si within a unit located in each of mixture of two or more thereof is used.

The inorganic fine powder may be treated with silicone oil, or may be treated together with the above-mentioned hydrophobic treatment.

Silicone oil having a viscosity of 30 to 1,000 $mm^2/s$ at 25° C. is preferably used. Examples of particularly preferable silicone oil include dimethyl silicone oil, methylphenyl silicone oil, α-methylstyrene-denatured silicone oil, chlorophenyl silicone oil, and fluorine-denatured silicone oil.

Examples of a method for treatment with silicone oil that can be employed include: a method involving directly mixing a silica fine powder treated with a silane coupling agent and silicone oil by using a mixer such as a Henschel mixer; a method involving spraying a silica fine powder serving as a base with silicone oil; and a method involving dissolving or dispersing silicone oil into an appropriate solvent, and adding and mixing a silica fine powder to and with the solution to remove the solvent. After silica has been treated with silicone oil, the temperature of the silica treated with silicone oil is preferably heated to 200° C. or higher (more preferably 250° C. or higher) in an inert gas so that the coat on the surface of silica is stabilized.

One of nitrogen atom-containing silane coupling agents such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine can be used alone or in combination. As a preferable silane coupling agent, there is given hexamethyldisilazane (HMDS).

In the present invention, one obtained by means of a method involving treating silica with a coupling agent in advance and treating the resultant with silicone oil, or a method involving treating silica with a coupling agent and silicone oil simultaneously is preferable.

A fluidity improver having a specific surface area according to nitrogen absorption measured by means of a BET method of 30 $m^2/g$ or more, or preferably 50 $m^2/g$ or more provides good results. The fluidity improver is desirably used in an amount of 0.01 to 8 parts by mass, or preferably 0.1 to 4 parts by mass with respect to 100 parts by mass of the toner particles.

In addition, any external additive other than an electrostatic property improver may be added to the toner of the present invention as required.

Examples of such external additive include resin fine particles and inorganic fine particles serving as charging adjuvants, conductivity imparting agents, fluidity imparting agents; caking inhibitors, release agents, lubricants, and abrasives. For example, lubricants such as Teflon (trademark), zinc stearate, and polyvinylidene fluoride can be exemplified, and, of those, polyvinylidene fluoride is preferable. Alternatively, abrasives such as cerium oxide, silicon carbide, and strontium titanate can be exemplified, and, of those, strontium titanate is preferable. Alternatively, fluidity imparting agents such as titanium oxide and aluminum oxide can be exemplified, and, of those, a fluidity imparting agent which is hydrophobic is particularly preferable. Caking inhibitors, or conductivity imparting agents such as carbon black, zinc oxide, antimony oxide, and tin oxide may also be used. In addition, fine particles opposite in polarity can be used in a small amount as a developability improver.

The amount of resin fine particles, an inorganic fine powder, a hydrophobic inorganic fine powder, or the like to be mixed with the toner is preferably 0.1 to 5 parts by mass with respect to 100 parts by mass of the toner.

The toner of the present invention preferably has a weight average particle size of 3 to 9 μm in terms of image density, resolution, and the like.

The toner of the present invention can be obtained by: sufficiently mixing a binder resin, a colorant, any other additive, and the like by using a mixer such as a Henschel mixer or a ball mill; melting and kneading the mixture by using a heat kneader such as a heat roll, a kneader, or an extruder; cooling the kneaded product to be solidified; grinding and classifying the solidified product; and sufficiently mixing a desired additive with the resultant by using a mixer such as a Henschel mixer as required.

Figure 2:
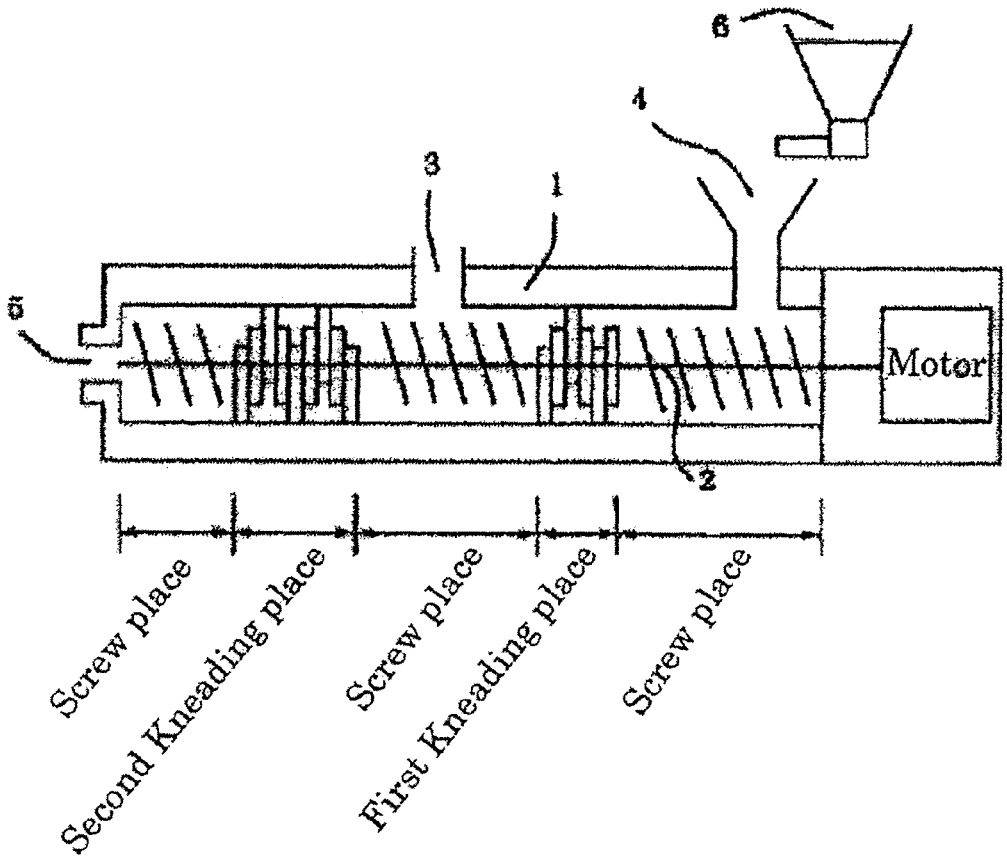
FIG. 2 is a schematic view showing an kneading device.
Figure 3:
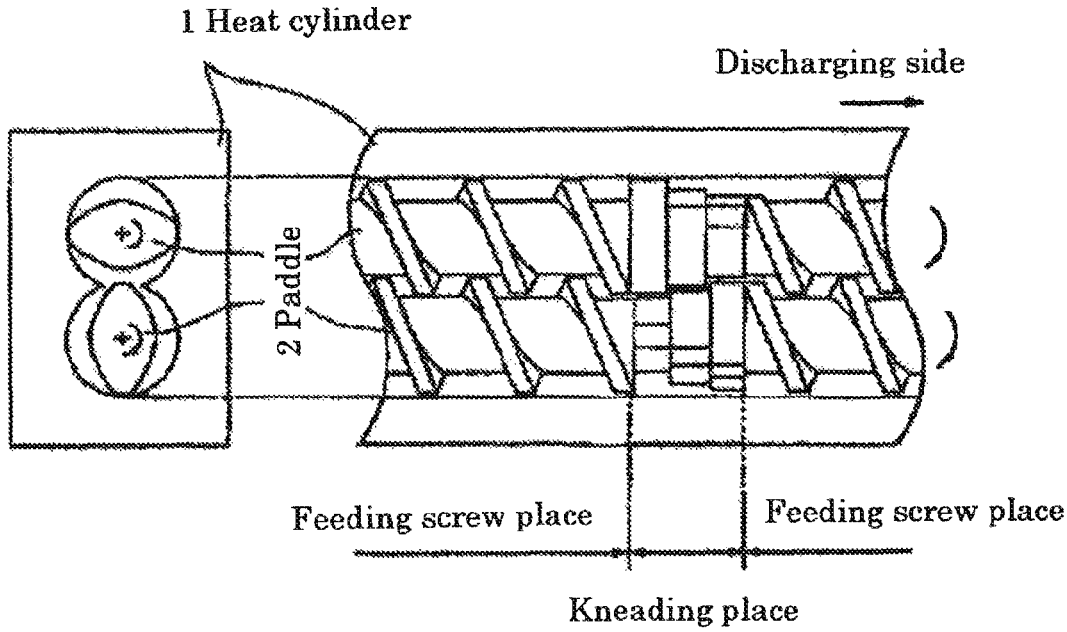
FIG. 3 is a detailed view of a paddle in the kneading device.

Among the above mentioned production steps, the melting and kneading step is the most important step for optimizing wax dispersibility of the present invention. FIG. 2 is a schematic view showing an kneading device of the present invention. FIG. 3 is a detailed view of a paddle in the kneading device. As shown in FIG. 2, it is preferable to have kneading at two or more places in the kneading device. Performing the kneading at two or more places leads the kneaded product into molten state completely. By kneading as described above, the optimum dispersibility of raw material of toner and wax can be obtained.

In order to obtain the toner of the present invention, it is more preferable to keep a first kneading place located closer to a feeding port at a high temperature, and a second kneading place closer to a discharging port at a low temperature. Especially, it is preferable that a temperature difference between the two kneading places is equal to or higher than 10° C. By constituting the production steps as described above, wax components are finely and uniformly dispersed in the toner, and, thereby the effects of the present invention can be easily obtained. In other words, at the first kneading place at the high temperature, a release agent is completely molten and diffused throughout the toner, And, at the second kneading place at a low temperature, the release agent, having spread and diffused to some extent is taken into the toner. Therefore, the dispersed state of the release agent specific to the present invention can be easily obtained. In the absence of the above-described temperature difference between the two kneading places, wax can be relatively movable even when it is taken into the toner. As a result, the finely dispersed wax gravitates each other and is liable to unevenly distributed in the toner.

Examples of a mixer include: a Henschel mixer (manufactured by Mitsui Mining Co., Ltd.); a Super mixer (manufactured by Kawata); a Ribocorn (manufactured by Okawara Corporation); a Nauta mixer, a Turbulizer, and a Cyclomix (manufactured by Hosokawa Micron Corporation); a Spiral pin mixer (manufactured by Pacific Machinery & and Engineering Co., Ltd.); and a Lodige mixer (manufactured by Matsubo Corporation). Examples of a kneader include: a KRC kneader (manufactured by Kurimoto, Ltd.); a Buss co-kneader (manufactured by Buss); a TEM extruder (manufactured by Toshiba Machine Co., Ltd.); a TEX biaxial kneader (manufactured by Japan Steel Works Ltd.); a PCM kneader (manufactured by Ikegai); a Three-roll mill, a Mixing roll mill, and a Kneader (manufactured by Inoue Manufacturing Co., Ltd.); a Kneadex (manufactured by Mitsui Mining Co., Ltd.); an MS pressure kneader and a Kneader-ruder (manufactured by Moriyama Manufacturing Co., Ltd.); and a Banbury mixer (manufactured by Kobe Steels, Ltd.). Examples of a grinder include: a Counter jet mill, a Micronjet, and an Inomizer (manufactured by Hosokawa Micron Corporation); and IDS mill and a PJM jet grinder (manufactured by Nippon Pneumatic Mfg, Co., Ltd.); a Cross jet mill (manufactured by Kurimoto, Ltd.); and Urumax (manufactured by Nisso Engineering Co., Ltd.); an SK Jet O Mill (manufactured by Seishin Enterprise Co., Ltd.); a Kryptron system (manufactured Kawasaki Heavy Industries); a Turbo mill (manufactured by Turbo Kogyo Co., Ltd.); and a Super rotor (manufactured by Nisshin Engineering Inc.). Examples of a classifier include: a Classiel, a Micron classifier, and a Spedic classifier (manufactured by Seishin Enterprise Co., Ltd.); a Turbo classifier (manufactured by Nisshin Engineering Inc.); a Micron separator, a Turboplex (ATP), and a TSP separator (manufactured by Hosokawa Micron Corporation); an Elbow jet (manufactured by Nittetsu Mining Co., Ltd.); a Dispersion separator (manufactured by Nippon Pneumatic Mfg, Co., Ltd.); and a YM microcut (manufactured by Yasukawa Shoji). Examples of a sieving device, i.e., classifier, to be used for sieving coarse particles and the like include: an Ultrasonic (manufactured by Koei Sangyo Co., Ltd.); a Resonasieve and a Gyrosifter (manufactured by Tokuju Corporation); a Vibrasonic system (manufactured by Dalton Corporation); a Soniclean (manufactured by Shintokogio Ltd.); a Turbo screener (manufacture by Turbo Kogyo Co., Ltd.); a Microsifter (manufactured by Makino mfg Co., Ltd.); and a circular vibrating screen.

Hereinafter, methods of measuring physical properties according to the present invention will be described.

(1) GPC-RALLS-Viscometer Analysis (i) Pretreatment

A sample (0.1 g in the case of toner, 0.05 g in the case of a binder resin) is placed into a 20-ml test tube together with 10 ml of THF, and the mixture is dissolved at 25° C. for 24 hours. After that, the resultant is passed through a sample treatment filter (having a pore size of 0.2 to 0.5 μm, for example, a Maishori Disk H-25-2 (manufactured by TOSOH CORPORATION) can be used), and is regarded as a sample for GPC.

(ii) Analysis Conditions

Device: HLC-8120GPC manufactured by TOSOH CORPORATION
- DAWN EOS (manufactured by Wyatt Technology Corporation)
- High-temperature differential pressure viscosity detector (manufactured by Viscotek)

Column: Combination of four columns KF-807, 806M, 805, and 803 (manufactured by SHOWA DENKO K.K.) in series Detector 1: Multi-angle light scattering detector Wyatt DAWN EOS Detector 2: High-temperature differential pressure viscosity detector Detector 3: Brice differential refractometer Temperature: 40° C.

Solvent: THF

Flow rate: 1.0 ml/min

Injection amount: 400 μl

In this measurement, a molecular weight distribution based on an absolute molecular weight, a square radius of inertia, and an intrinsic viscosity are directly outputted. A theory for the measurement is as shown below.

[Measurement Theory]

$M90=R(\theta_{90})/KC$ . . . Rayleigh equation

M90: Molecular weight at 90°

$R(\theta_{90})$: Rayleigh ratio at a scattering angle of 90°

K: Optical constant $(=2\pi^2n^2/\lambda_0^4N_A\cdot(dn/dc)^2)$

C: Solution concentration $Rg=(1/6)^{1/2}([\eta]M_{90}/\Phi)^{1/3}$ . . . Flory Fox equation Rg: Inertial radius η: Intrinsic viscosity Φ: Shape element Absolute molecular weight: $M=R(\theta_0)/KC$ $R(\theta_0)=R(\theta_{90})/P(\theta_{90})$ $P(\theta_{90})=2/X^2\cdot(e^{-x}-(1-X))$ $(X=4\pi n/\lambda\cdot R_g)$ λ: Wavelength Here a value for (dn/dc) was set to 0.089 ml/g for a hybrid resin-containing toner, 0.078 ml/g for a toner containing only a polyester resin, or 0.185 ml/g for linear polystyrene. By using polystyrene (TSK standard POLYSTYRENE A-2500, A-5000, F-1, F-2, F-4, F-10 and F-40 (manufactured by TOSOH CORPORATION)), a standard curve was calculated from each molecular weight value and square radius of inertia of the polystyrene. The square radius of inertia Rp at a peak top of a main peak in linear polystyrene was obtained from the standard curve.

(2) Method of Measuring Softening Point of Each of Resin and Toner

The term "softening point" refers to one measured by using a Koka type flow tester in conformance with JIS K 7210. A specific measurement method is shown below. While 1 $cm^3$ of a sample is heated by using a Koka type flow tester (product name: CFT-500D, manufactured by Shimadzu Corporation) at a rate of temperature increase of 4° C./min, a load of 980 $N/m^2$ (i.e., 10 $kg/cm^2$) is applied to the sample by using a plunger so that a nozzle having a diameter of 1 mm and a length of 1 mm is extruded. A plunger fall out amount (i.e., flow value)-temperature curve is drawn on the basis of the result of the extrusion. The height of the S-shape curve is represented by h, and the temperature corresponding to h/2 (i.e., the temperature at which one half of a resin flows out) is defined as a softening point.

(3) Measurement of: glass transition temperature (Tg) of each of resin and toner; melting point of release agent; and heat of formation ΔH1 and heat of formation ΔH2 Measuring device: Measurement is performed in accordance with ASTM D3418-82 by using a differential scanning calorimeter (DSC), MDSC-2920 (manufactured by TA Instruments)

2 to 10 mg, preferably 3 mg, of a measurement sample are precisely weighed. The sample is placed into an aluminum pan, and measurement is performed in the measurement temperature range of 30 to 200° C. and at a rate of temperature increase of 10° C./min at normal temperature and normal humidity by using an empty aluminum pan as a reference. Analysis is performed by using a DSC curve in the temperature range of 30 to 200° C. obtained in a second heating process.

A value obtained by analyzing the resultant DSC curve by a middle point method is used for a glass transition temperature (Tg). In addition, a value for the temperature at which an endothermic main peak of the resultant DSC curve is present is used as the melting point of a release agent. In addition, a value obtained by integrating the area of the endothermic main peak is used for each of heat of formation ΔH1 and heat of formation ΔH2. The area of the endothermic main peak is an area represented in a diagonal line portion in the case of FIG. 1.

(4) Acid Value of Each of Resin and Toner

In the present invention, the acid value (JIS acid value) of each of a resin and a toner is determined by the following method. It should be noted that the acid value of each of the resin and the toner means the acid value of the THF soluble matter of each of the raw material resin and the toner.

A basic operation is in conformance with JIS K-0070.

1) The THF insoluble matter of each of the toner and the resin is removed in advance before a sample is used. 0.5 to 2.0 (g) of the pulverized product of the sample are precisely weighed, and the weight of a soluble component is represented by W (g).

2) The sample is placed into a 300-ml beaker, and 150 ml of a mixed liquid of toluene and ethanol (at a ratio of 4/1) are added to dissolve the sample.

3) Titration is performed by using a 0.1-mol/l solution of KOH in ethanol and a potentiometric titration apparatus (for example, automatic titration using a potentiometric titration apparatus AT-400 (win workstation) manufactured by Kyoto Denshi and an electrically-driven bullet ABP-410 can be utilized).

4) The amount of the solution of KOH used in this case is represented by S [ml]. In addition, a blank test using no sample is simultaneously performed, and the amount of the solution of KOH used in this case is represented by B [ml].

5) An acid value is calculated from the following expression. f represents the factor of KOH.

Acid value (mgKOH/g)=[(S−B)×f×5.61]/W (5) Hydroxyl Value

A basic operation is in conformance with JIS K 0070.

[Device and Instrument]

Measuring cylinder (100 ml)

Whole pipette (5 ml)

Round flask (200 ml)

Glycerin bath

[Reagent]

Acetylating reagent (prepared by: loading 25 g of acetic anhydride into a 100-ml whole flask; adding pyridine to the flask so that a total amount is 100 ml; and sufficiently shaking the mixture) Phenolphthalein solution 0.5-mol/l solution of potassium hydroxide in ethanol

[Measurement Method]

(a) 0.5 to 6.0 g of a sample are precisely weighed and placed into the round flask, and 5 ml of the acetylating reagent are added to the flask by using the whole pipette.

(b) A small funnel is placed at the opening of the flask, and heating is performed by immersing the part of the flask corresponding to a height of up to about 1 cm from the bottom of the flask in the glycerin bath at a temperature of 95 to 100° C. The base of the neck of the flask is covered with a disk made of cardboard and perforated with a round hole at its center in order that the temperature of the neck of the flask may be prevented from increasing owing to heat from the glycerin bath.

(c) 1 hour after that, the flask is taken out of the glycerin bath, and is left standing to cool. Then, 1 ml of water is added from the funnel, and the flask is shaken so that acetic anhydride is decomposed.

(d) Further, in order to make the decomposition perfect, the flask is heated in the glycerin bath for 10 minutes again. After that, the flask is left standing to cool, and then the funnel and the wall of the flask are washed with 5 ml of ethanol (95%).

(e) Several drops of the phenolphthalein solution are added as an indicator, and titration is performed by using the 0.5-mol/l solution of potassium hydroxide in ethanol. The amount of the solution of potassium hydroxide at which the indicator maintains its pale red color for about 30 seconds is defined as an end point.

(f) In a blank test, the above steps (a) to (e) are performed without loading any sample.

(g) When the sample is hardly dissolved, a small amount of pyridine is added, or xylene or toluene is added to dissolve the sample.

[Calculation]

$$A=[\{(B-C)\times 28.05\times f\}/S]+D$$

where A: hydroxyl value (mgKOH/g)

B: amount (ml) of the 0.5-mol/l solution of potassium hydroxide in ethanol used in the blank test C: amount (ml) of the 0.5-mol/l solution of potassium hydroxide in ethanol used in the titration f: factor of the 0.5-ml/l solution of potassium hydroxide in ethanol S: mass (g) of the sample D: acid value 28.05: 56.11 as the formula weight of potassium hydroxide×½

EXAMPLES

Hereinafter, the present invention will be specifically described by way of examples. However, the present invention is not limited to these specific examples.

<Production Example of Binder Resin a>

Bisphenol A ethylene oxide adduct (2.2 mol adduct): 46.4 mol %

Ethylene glycol: 3.3 mol %

Terephthalic acid: 43.0 mol %

Anhydrous trimellitic acid: 3.0 mol %

Acrylic acid: 3.3 mol %

The above polyester monomer (PL-1) was loaded into a four-necked flask. The flask was mounted with a decompression device, a water separating device, a nitrogen gas introducing device, a temperature measuring device, and a stirring device. Then, under a nitrogen atmosphere, the monomer was stirred at 160° C. A mixture of a vinyl polymerizable monomer (SL-1, (90.0 mol % of styrene and 8.0 mol % of 2-ethylhexyl acrylate)) and 2.0 mol % of benzoyl peroxide (BPO) as a polymerization initiator was dropped to the flask from a dropping funnel over 4 hours. After that, the resultant mixture was subjected to a reaction at 160° C. for 5 hours, and then the temperature was increased to 230° C. 0.2 mass % of dibutyltin oxide (DBO) was added to the resultant, and the whole was subjected to a condensation polymerization reaction for 6 hours. Further, the temperature was increased to 240° C., 1.0 mol % of trimellitic anhydride was added to the resultant, and the whole was subjected to a condensation polymerization reaction for an additional 2 hours. After the completion of the reaction, the resultant was taken out of the flask, cooled, and pulverized, whereby a binder resin a was obtained. List of composition of each of low-molecular weight bodies (PES part) is shown in table 1, list of composition of each of low-molecular weight bodies (StAc part) is shown in table 2 and the conditions in manufacturing the resins with the methods of polymerizing low-molecular weight resins are shown in table 3.

Such production method as described above is adopted because the method is the best form for obtaining a branched low-molecular weight polymer which is characteristic of the present invention.

First, a vinyl polymerizable monomer or an unsaturated polyester resin is subjected to an addition polymerization reaction in order that a main chain having a low molecular weight necessary for gloss control may be obtained. The control of the molecular weight of the main chain facilitates the obtainment of desired gloss.

Next, raw material monomers for a polyester unit are subjected to a condensation polymerization reaction in two stages. In a first step, a monomer as a side chain is polymerized with a polymer as a main chain, whereby a branched polymer having a low degree of branching is produced. In a second step, a condensation polymerization reaction is performed at an additionally high temperature, whereby a uniform, branched polymer with an additionally increased degree of branching is produced. The performance of condensation polymerization in two stages as described above can result in a low-molecular weight polymer with improved uniformity and an increased degree of branching.

The physical properties of the binder resin a are as shown in Table 4.

<Production Examples of Binder Resins b to g>

Binder resins b to g were obtained by using the monomers shown in Tables 1 and 2 according to the production conditions shown in Table 3. The physical properties of those resins are as shown in Table 4.

<Product Example of Binder Resin h>

Bisphenol A propylene oxide adduct (2.2 mol adduct): 52.3 mol %

Terephthalic acid: 18.0 mol %

Adipic acid: 5.7 mol %

Isophtalic acid: 24.0 mol %

The above polyester monomer (PL-6) and 0.2 mass % of dibutyltin oxide were loaded into a four-necked flask. The flask was mounted with a decompression device, a water separating device, a nitrogen gas introducing device, a temperature measuring device, and a stirring device. Then, under a nitrogen atmosphere, the temperature was increased to 230° C., and a condensation polymerization reaction was performed. After the completion of the reaction, the resultant was taken out of the flask, cooled, and pulverized, whereby a polyester resin was obtained. 70 parts by mass of the polyester resin were loaded into the flask again, and were dissolved while the temperature was increased to 180° C. A vinyl polymerizable monomer (SL-5 (a mixture of 29.8 parts by mass of styrene and 0.2 part by mass of benzoyl peroxide as a polymerization initiator) was dropped to the solution from a dropping funnel over 4.8 hours. The mixture was subjected to a reaction for 2 hours while the temperature was kept at 180° C. After that, the resultant was subjected to distillation under reduced pressure at 150° C. over 3 hours, whereby the remaining monomer was removed, and, at the same time, hybridization due to an ester bond between a styrene-acrylic resin and unsaturated polyester was performed. After the completion of the reaction, the resultant was taken out of the flask, cooled, and pulverized, whereby a binder resin h was obtained.

The physical properties of the binder resin h are as shown in Table 4.

<Production Examples of Binder Resins i to j>

Binder resins i to j were obtained by using the monomers shown in Tables 1 to 2 according to the production conditions shown in Table 3 in a similar manner as the binder resin h. The physical properties of those resins are as shown in Table 4.

<Production Examples of Binder Resin k>

The above polyester monomer (PL-8) and 0.2 mass % of dibutyltin oxide were loaded into a four-necked flask. The flask was mounted with a decompression device, a water separating device, a nitrogen gas introducing device, a temperature measuring device, and a stirring device. Then, under a nitrogen atmosphere, the temperature was increased to 230° C., and a condensation polymerization reaction was performed. After the completion of the reaction, the resultant was taken out of the flask, cooled, and pulverized, whereby a polyester resin was obtained.

The physical properties of the binder resin a are as shown in Table 4.

TABLE 1

List of composition of a each of low-molecular weight bodies (PES part)

| | BPA-PO (mol %) | BPA-EO (mol %) | EG (mol %) | PEL (mol %) | DSA (mol %) | TPA (mol %) | Adipic acid (mol %) | TMA (mol %) | FA (mol %) | Acrylic acid (mol %) | IPA (mol %) |
|---|---|---|---|---|---|---|---|---|---|---|---|
| PL-1 | — | 46.4 | 3.3 | — | — | 43.0 | — | 4.0 | — | 3.3 | — |
| PL-2 | — | 44.2 | 3.2 | 2.3 | — | 42.7 | — | 4.3 | — | 3.3 | — |
| PL-3 | — | 46.1 | 3.6 | — | — | 39.3 | — | 6.2 | — | 4.5 | — |
| PL-4 | — | 46.8 | — | — | — | 45.2 | — | 2.0 | — | 3.1 | — |
| PL-5 | 40.8 | 20.0 | — | — | — | 25.9 | — | 0.6 | 12.7 | — | — |
| PL-6 | 52.3 | — | — | — | — | 18.0 | 5.7 | — | — | — | 24.0 |
| PL-7 | 2.6 | 50.0 | — | — | 5.3 | 26.3 | — | 8.0 | — | 7.8 | — |
| PL-8 | 47.1 | — | — | — | — | 49.6 | — | 3.3 | — | — | — |
| PL-9 | 52.6 | — | — | — | 7.6 | 39.5 | — | — | — | 0.3 | — |

BPA-PO: Adduct of bisphenol A with propylene oxide

BPA-EO: Adduct of bisphenol A with ethylene oxide

EG: Ethylene glyocl

PEL: Pentaerythritol

DSA: Dodecenylsuccinic acid

TPA: Terephthalic acid

Adipic acid

TMA: Trimellitic anhydride

FA: Fumaric acid

Acrylic acid

IPA: Isophthalic acid (Each of the symbols in the following tables has the same meaning as that described above.

TABLE 2

| List of composition of each of low-molecular weight bodies (StAc part) | | |
|---|---|---|
| | St (mol %) | 2EHA (mol %) |
| SL-1 | 90.0 mol % | 8.0 mol % |
| SL-2 | 90.3 mol % | 8.2 mol % |
| SL-3 | 7.3 parts by mass | 2.5 parts by mass |

TABLE 2-continued

| List of composition of each of low-molecular weight bodies (StAc part) | | |
|---|---|---|
| | St (mol %) | 2EHA (mol %) |
| SL-5 | 29.8 parts by mass | — |
| SL-6 | 89.9 mol % | 8.1 mol % |

ST: Styrene
2EHA: 2-ethylhexyl acrylate
(Each of the symbols in the following tables has the same meaning as that described above.)

TABLE 3

Methods of polymerizing low-molecular weight resins

| | | | Addition polymerization | | Condensation polymerization 1 | | | Condensation polymerization 2 | | |
|---|---|---|---|---|---|---|---|---|---|---|
| | PES part/ Addition amount | StAc part/ Addition amount | Kind/ amount of initiator | Reaction temperature | Kind/ amount of catalyst | Reaction temperature | Reaction time [h] | Kind/ amount of added monomer | Reaction temperature | Reaction time [h] |
| Binder Resin a | PL-1/80 | SL-1/20 | BPO/2.0 mol % | 160° C. | DBO/0.2 mass % | 230° C. | 6 | TMA/ 1 mol % | 240° C. | 2 |
| Binder Resin b | PL-1/80 | SL-2/20 | BPO/1.5 mol % | 160° C. | DBO/0.2 mass % | 230° C. | 5 | TMA/ 1 mol % | 240° C. | 3 |
| Binder Resin c | PL-1/80 | SL-3/20 | BPO/3.0 mol % | 160° C. | DBO/0.2 mass % | 230° C. | 6 | TMA/ 1 mol % | 240° C. | 2 |
| Binder Resin d | PL-2/80 | SL-1/20 | BPO/2.0 mol % | 160° C. | DBO/0.2 mass % | 230° C. | 6 | TMA/ 1 mol % | 240° C. | 2 |
| Binder Resin e | PL-3/80 | SL-1/20 | BPO/2.0 mol % | 160° C. | DBO/0.2 mass % | 230° C. | 6 | TMA/ 2 mol % | 240° C. | 3 |
| Binder Resin f | PL-4/80 | SL-1/20 | BPO/2.0 mol % | 150° C. | DBO/0.2 mass % | 230° C. | 7 | — | 240° C. | 1 |
| Binder Resin g | PL-5/90 | SL-4/10 | BPO/0.2 mass % | 150° C. | DBO/0.2 mass % | 230° C. | 6 | TMA/0.3 mol % | 240° C. | 2 |
| Binder Resin h | PL-6/70 | SL-5/30 | BPO/0.2 mass % | 180/150° C. | DBO/0.2 mass % | 230° C. | 8 | — | — | — |
| Binder Resin i | PL-7/80 | SL-6/20 | BPO/2.0 mol % | 140° C. | DBO/0.2 mass % | 230° C. | 8 | — | — | — |
| Binder Resin j | PL-9/80 | SL-6/20 | BPO/2.0 mol % | 140° C. | DBO/0.2 mass % | 230° C. | 8 | — | — | — |
| Binder Resin k | PL-8/100 | — | — | — | DBO/0.2 mass % | 230° C. | 8 | — | — | — |

BPO: Benzoyl peroxide
DBO: Dibutyltin oxide
TMA: Trimellitic anhydride
(Each of the symbols in the following tables has the same meaning as that described above.)

TABLE 4

List of physical properties of low-molecular weight resins

| | Results of GPC-RALLS-viscometer analysis | | | | | | | | | | | | |
|---|---|---|---|---|---|---|---|---|---|---|---|---|---|
| | Peak top | | | Entire peak | | | | | | Softening | | Acid | Hydroxyl value |
| | Mp | RgL | RgL/ Rgp | Mw | Mw/ Mn | RgwL | Ratio of molecules each having an square radius of inertia of 5 nm or less | Ratio of molecules each having a molecular weight of 20,000 or less | IVwL [ml/g] | point (° C.) | Tg (° C.) | value (mgKOH/g) | (mgKOH/ g) |
| Binder Resin a | 13090 | 3.3 | 0.70 | 16540 | 1.1 | 3.9 | 88.0 | 88.3 | 0.11 | 96.2 | 52.9 | 31.5 | 54.3 |

TABLE 4-continued

| List of physical properties of low-molecular weight resins | | | | | | | | | | | | | |
|---|---|---|---|---|---|---|---|---|---|---|---|---|---|
| | Results of GPC-RALLS-viscometer analysis | | | | | | | | | | | | |
| | Peak top | | | Entire peak | | | | | | | | | |
| | Mp | RgL | RgL/Rgp | Mw | Mw/Mn | RgwL | Ratio of molecules each having an square radius of inertia of 5 nm or less | Ratio of molecules each having a molecular weight of 20,000 or less | IVwL [ml/g] | Softening point (° C.) | Tg (° C.) | Acid value (mgKOH/g) | Hydroxyl value (mgKOH/g) |
| Binder Resin b | 15100 | 3.1 | 0.65 | 18550 | 1.2 | 4.2 | 82.0 | 86.2 | 0.15 | 98.2 | 53.0 | 30.1 | 55.1 |
| Binder Resin c | 11300 | 2.9 | 0.67 | 14320 | 1.1 | 3.1 | 94.0 | 89.7 | 0.11 | 92.7 | 52.5 | 32.3 | 52.1 |
| Binder Resin d | 16200 | 3.1 | 0.58 | 18100 | 1.1 | 3.5 | 83.0 | 82.1 | 0.15 | 98.7 | 53.4 | 27.1 | 59.5 |
| Binder Resin e | 18200 | 2.8 | 0.49 | 20030 | 1.1 | 3.3 | 80.0 | 76.4 | 0.17 | 100.2 | 54.5 | 33.4 | 51.6 |
| Binder Resin f | 9800 | 3.6 | 0.90 | 11000 | 1.2 | 3.9 | 95.0 | 94.7 | 0.10 | 91.8 | 52.1 | 26.1 | 60.2 |
| Binder Resin g | 12300 | 3.3 | 0.73 | 15500 | 1.3 | 3.5 | 89.0 | 79.6 | 0.11 | 93.4 | 52.6 | 32.0 | 52.7 |
| Binder Resin h | 12700 | 4.2 | 0.91 | 16100 | 1.4 | 4.6 | 88.0 | 72.1 | 0.11 | 96.4 | 53.8 | 12.1 | 41.3 |
| Binder Resin i | 15730 | 3.1 | 0.59 | 20300 | 1.5 | 3.3 | 80.0 | 69.1 | 0.18 | 102.5 | 55.0 | 32.1 | 52.5 |
| Binder Resin j | 8000 | 3.1 | 0.87 | 9000 | 1.2 | 3.4 | 97.0 | 97.1 | 0.10 | 90.3 | 52.1 | 29.4 | 57.3 |
| Binder Resin k | 33000 | 4.5 | 0.57 | 38000 | 1.6 | 4.9 | 71.0 | 11.3 | 0.19 | 115.0 | 55.0 | 12.0 | 36.0 |

<Production Example of Binder Resin A>

A binder resin A was obtained by using the monomers shown in Tables 5 and 6 according to the production method shown in Table 7. The physical properties of the resin are as shown in Table 8.

<Production Example of Binder Resin B>

A binder resin B was obtained by using the monomers shown in Table 5 according to the production method shown in Table 7. The physical properties of the resin are as shown in Table 8.

TABLE 5

| List of composition of each of high-molecular weight bodies (PES part) | | | | | | | | |
|---|---|---|---|---|---|---|---|---|
| | BPA-PO (mol %) | BPA-EO (mol %) | PNO (mol %) | TPA (mol %) | TMA (mol %) | DSA (mol %) | Acrylic acid (mol %) | IPA (mol %) |
| PH-1 | 32.6 | 16.3 | — | 36.7 | 6.1 | 6.1 | 2.2 | — |
| PH-2 | 46.8 | — | 0.6 | 35.0 | 11.8 | — | — | 5.8 |

PNO: Adduct of phenol novolac with EO (Each of the symbols in the following tables has the same meaning as that described above.)

TABLE 6

| List of composition of high-molecular weight body (StAc part) | | |
|---|---|---|
| | St | 2EHA |
| SH | 88.8 mol % | 10.2 mol % |

TABLE 7

| Methods of polymerizing high-molecular weight resins | | | | | | |
|---|---|---|---|---|---|---|
| | | | Addition polymerization | | Condensation polymerization | |
| | PES part/ Addition amount | StAc part/ Addition amount | Kind/amount of initiator | Reaction temperature | Kind/amount of catalyst | Reaction temperature |
| Binder Resin A | PH-1/80 | SH/20 | BPO/1.0 mol % | 140° C. | DBO/0.2 mass % | 230° C. |
| Binder Resin B | PH-2/100 | — | — | — | DBO/0.2 mass % | 230° C. |

TABLE 8

| List of physical properties of high-molecular weight resins | | | | | | | | | | | | | | |
|---|---|---|---|---|---|---|---|---|---|---|---|---|---|---|
| | Results of GPC-RALLS-viscometer analysis | | | | | | | | | | | | | |
| | Peak top | | | Entire peak | | | | | | | | | | |
| | Mp | RgH | RgH/ Rgp | Mw | Mw/Mn | RgwH | Ratio of molecules each having an square radius of inertia of 5 nm or less | Ratio of molecules each having a molecular weight of 20,000 or less | IvwH [ml/ g] | Softening point (° C.) | Tg (° C.) | Acid value (mgKOH/ g) | Hydroxyl value (mgKOH/ g) |
| Binder Resin A | 17830 | 3.8 | 0.68 | 467500 | 21.5 | 12.3 | 43.1 | 25.2 | 0.41 | 135.1 | 52.4 | 18.8 | 31.6 |
| Binder Resin B | 55000 | 5.3 | 0.51 | 756000 | 21.3 | 14.8 | 25.1 | 1.3 | 0.55 | 142.0 | 57.0 | 24.0 | 22.0 |

TABLE 9

| | Kinds | Melting point (° C.) | Peak molecular weight of Wax | Minimum square radius (nm) | Penetration degree at 25° C. (mm) |
|---|---|---|---|---|---|
| Wax1 | Purified paraffin wax | 75 | 1202 | 1.53 | 7 |
| Wax2 | Fisher Tropsh Wax | 105 | 2247 | 2.47 | 0.1 |

TABLE 9-continued

| | Kinds | Melting point (° C.) | Peak molecular weight of Wax | Minimum square radius (nm) | Penetration degree at 25° C. (mm) |
|---|---|---|---|---|---|
| Wax3 | Ester Wax | 43 | 420 | 1.21 | 11 |
| Wax4 | Polypropylene Wax | 136 | 4110 | 3.78 | 0.1 or less |

Example 1

| | |
|---|---|
| Binder Resin a | 60 parts by mass |
| Binder Resin A | 40 parts by mass |
| Magnetic iron oxide particles A (average particle size of 0.14 μm, coercive force (Hc) = 11.5 kA/m, saturation magnetization (σs) = 90 $Am^2/kg$, residual magnetization (σr) = 16 $Am^2/kg$) | 90 parts by mass |
| Wax 1 | 3 parts by mass |

-continued

| | |
|---|---|
| Wax 2 | 2 parts by mass |
| Charge control agent-1 (shown below) | 2 parts by mass |

[Chem 2]

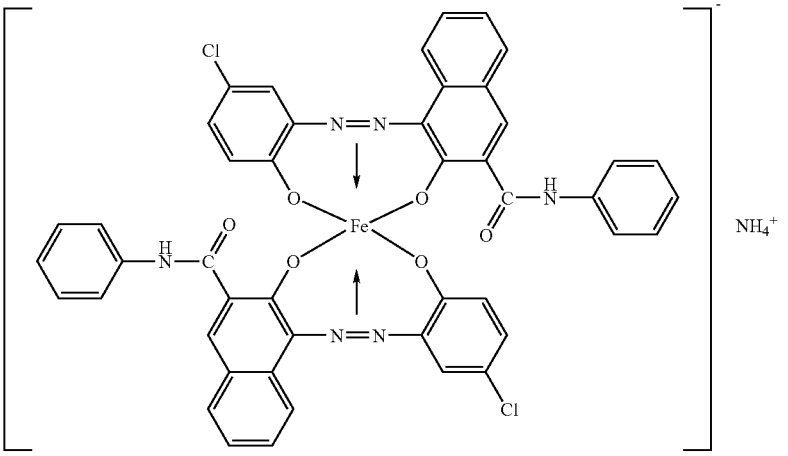

Charge control agent-1

The above-mentioned materials were premixed by using a Henschel mixer. After that, the mixture was melted and kneaded by using a biaxial kneading extruder. At this time, the mixture was melted and kneaded under the condition that the heating temperature of the first kneading place is 150° C., the heating temperature of the second kneading place is 130° C., the frequency of the paddle is 200 rpm. This condition is defined as Kneading condition 1.

The resultant kneaded product was cooled and coarsely ground by using a hammer mill. After that, the coarsely ground product was ground by using a turbo mill, and the resultant finely ground powder was classified by using a multi-division classifier utilizing a Coanda effect, whereby toner particles having a weight average particle size of 7.3 μm were obtained. 1.0 part by mass of a hydrophobic silica fine powder (BET 140 $m^2/g$) and 3.0 parts by mass of strontium titanate were externally added to and mixed with 100 parts by mass of the toner particles, and the mixture was sieved by using a mesh having an aperture of 150 μm, whereby Toner No. 1 was obtained.

Figure 4:
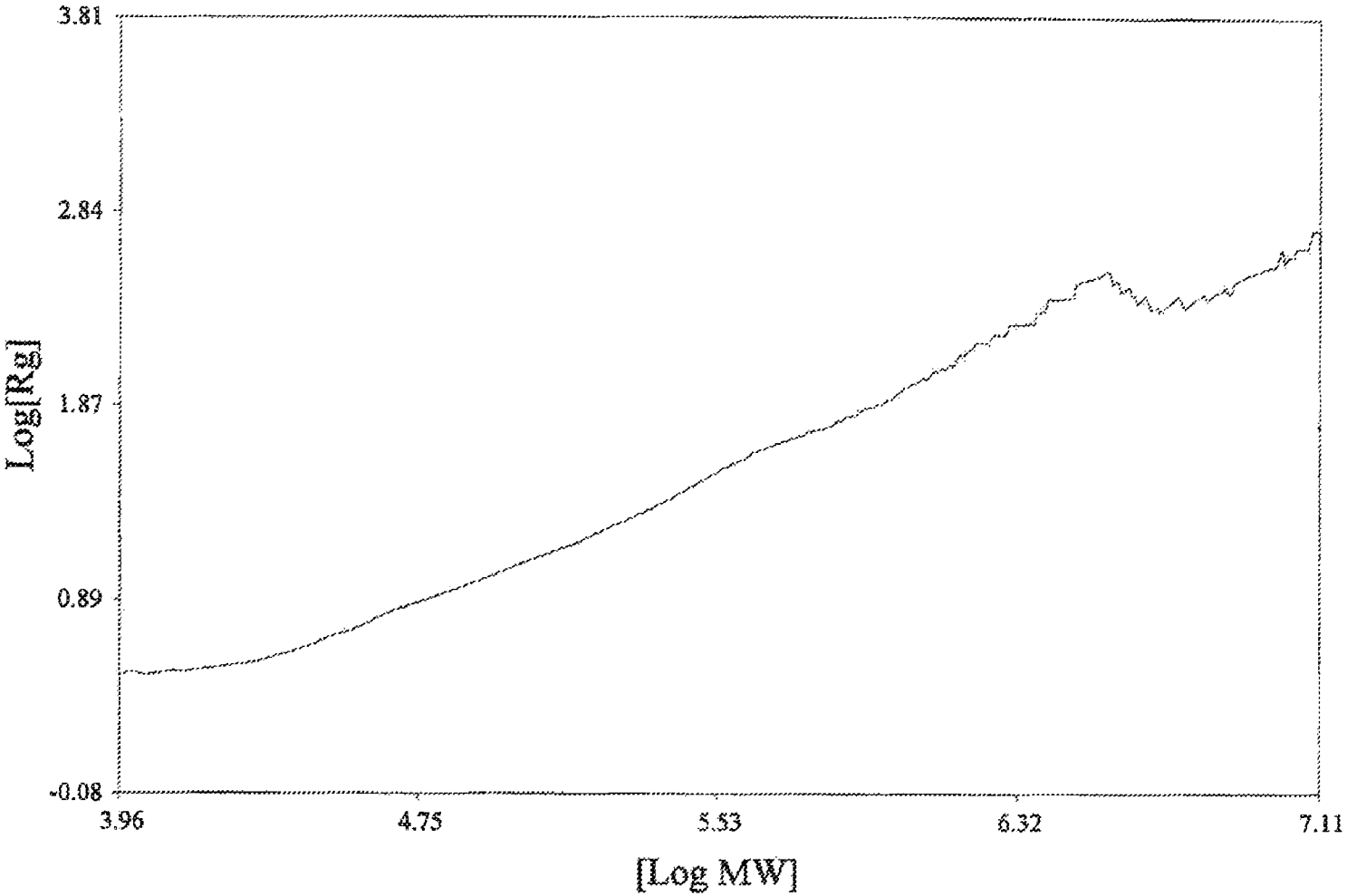
FIG. 4 shows the relationship of logarithm of square radius of inertia and number average molecular weight of Toner No. 1 measured with a GPC-RALLS-viscometer analyzer.

Tables 10 and 11 show the internal addition formulation and physical property values of toner, respectively. FIG. 4 shows the relationship of logarithm of square radius of inertia of Toner No. 1 measured with a GPC-RALLS-viscometer analyzer and logarithm of number average molecular weight of Toner No. 1.

A commercially available copying machine (IR-6010 manufactured by Canon Inc.) was reconstructed in such a manner that a print speed would be 1.7 times as high as the original speed. A 300,000-sheet continuous printing test for the toner No. 1 was then performed by using the reconstructed copying machine and a test chart having a printing ratio of 4% in each of an environment of 23° C. and 5% RH, an environment of 23° C. and 60% RH, and an environment of 32° C. and 80% RH. In addition, a fixing unit of a commercially available copying machine (IR-105 manufactured by Canon Inc.) was taken to the outside, and was reconstructed in such a manner that the fixing unit would be able to operate even outside the copying machine and that the temperature of a fixing roller, a process speed, and an applied pressure can be arbitrarily set. Evaluation for each of fixability and offset resistance was performed by using the resultant external fixing unit. Evaluation for fixability was performed by passing a solid black unfixed image on paper having a basis weight of 90 $g/m^2$ under conditions including a process speed of 600 mm/sec and an applied pressure of 30 $kgf/cm^2$. Evaluation for offset resistance was performed by passing an unfixed image on paper having a basis weight of 50 $g/m^2$ under conditions including a process speed of 50 mm/sec and an applied pressure of 50 $kgf/cm^2$.

(1) Fixability:

A solid black image was passed through a fixing unit, the temperature of which had been controlled to 140° C., and the resultant fixed image was rubbed with lens-cleaning paper while a load of 50 $g/cm^2$ was applied to the image. Evaluation for fixability was performed on the basis of a percentage by which an image density reduced after the rubbing as compared to the image density before the rubbing.

A: The rate of reduction is less than 10%.

B: The rate of reduction is 10% or more and less than 20%.

C: The rate of reduction is 20% or more.

(2) Resistance of Fixed Image Against Bending:

A fixed image was produced in the same manner as that described above. After that, a bending stress was applied to the fixed image, and the degree of an image defect was visually judged. The judgement criteria are as shown below.

A: No defects are generated in a fixed image.

B: An extremely small amount of defects are observed at a fold, but they cause no problem in practical use.

C: Image defects are generated to the extent that they can be clearly visually observed.

D: Remarkable image defects are generated particularly at a fold.

(3) Offset Resistance:

A sample image having an image area ratio of about 5% was printed out and passed through a fixing unit, the temperature of which had been controlled to 240° C. Evaluation for offset resistance was performed on the basis of the degree of contamination on the image.

A: Good

B: Slight contamination occurs.

C: Contamination which affects an image occurs.

(4) Evaluation for Gloss Using Fixing Device at Light Pressures

An image in which 9 squares (20 mm×20 mm) were arranged in a pattern having 3 columns and 3 rows was printed on an A4 plain paper (64 g/m$^2$) while the temperature of a fixing nip portion N in the image forming device was set at 170° C. by: removing, to the outside, a fixing unit of a commercially available LBP printer (Laser Jet 4300, manufactured by HP) using a fixing device composed of an applied pressure member for causing a recording material to come into close contact with the heating body via a film; and using an external fixing unit reconstructed in such a manner that the fixing unit could operate even outside the printer, the temperature of a fixing film could be arbitrarily set, and a process speed would be 350 mm/sec.

The gloss of the image was measured by using a handy glossmeter Glossmeter PG-3D (manufactured by Tokyo Denshoku Co., Ltd.) under conditions including an angle of incidence of light of 75°, and the average gloss value of the nine squares was determined. When the gloss value was high, it was judged that the image had a smooth surface and a color quality was such that the color had luster and high chroma. In contrast, when the gloss value was low, it was judged that the image was obscure and poor in chroma, and its surface was rough.

(5) Durable Stability of Gloss:

A commercially available copying machine (IR-6010 manufactured by Canon Inc.) was reconstructed in such a manner that a print speed would be 1.7 times as high as the original speed. A 300,000-sheet continuous printing test was performed by using the reconstructed copying machine and an image, in which nine squares (20 mm×20 mm) had been arranged like a matrix with three rows and three columns, in an environment of 23° C. and 60% RH. The gloss of the image was measured by using a handy glossmeter Glossmeter PG-3D (manufactured by Tokyo Denshoku Co., Ltd.) under conditions including an angle of incidence of light of 75°. Average gloss in one image at the initial stage of duration and average gloss on a 300,000-th sheet were compared with each other. Evaluation for the durable stability of gloss was performed by using a difference in gloss value on the basis of the following criteria.

A: A difference between average gloss at an initial stage and average gloss after duration is 5 or less.

B: A difference between average gloss at an initial stage and average gloss after duration is 10 or less.

C: A difference between average gloss at an initial stage and average gloss after duration is more than 10.

(6) Image Density:

The reflection density of a 5-mm square image was measured by using an SPI filter in a Macbeth densitometer (manufactured by GretagMacbeth). Fogging measurement was performed by using a reflection densitometer (REFLECTOMETER MODEL TC-6DS manufactured by Tokyo Denshoku Co., Ltd.). The worst value of the reflection density of a white ground portion after image formation was denoted by Ds, and the average reflection density of a transfer material before the image formation was denoted by Dr. Evaluation for fogging was performed on the basis of a value for Ds-Dr as a fogging amount. The lower the value, the better the suppression of fogging. The evaluation was performed at an initial stage and on a 300,000th sheet.

(7) Storage Stability:

10 g of developer were weighed and placed into a 50-cc polycup. The polycup was left in a thermostat at 50° C. for 7 days while a weight of 50 g was applied. Visual evaluation for blocking property after that was performed by using the following evaluation criteria.

A: The toner does not aggregate at all.

B: The aggregate of the toner can be collapsed by rotating the cup.

C: The aggregate of the toner is present, but the aggregate is gradually reduced and collapsed as the cup is rotated.

D: The aggregate of the toner remains even after the cup has been rotated and the aggregate has been collapsed.

E: The aggregate of the toner is large and cannot be collapsed even by rotating the cup.

(8) Bonding Property of Discharged Paper:

After 100-sheet printing test, transmission density of 5 points of the 100-th sheet in an environment of 35° C. and 80% RH was measured with Macbeth densitometer, and obtained average of the transmission density of 5 point was denoted by D1.

After 10,000-sheet duration printing test, 100-th paper was peeled off from the banked up paper and transmission density was measured with the same method as mentioned above.

The result was denoted by D2.

A value obtained from D1-D2 was calculated for papers of different conditions respectively, and the resulted values were ranked depending on the differences in the calculated results.

A: Density decrease less than 0.1

(A1: No peel off nor void image,

A2: With one point of peel off or void image of less than 1 mm in diameter,

A3: With one point of peel off or void image of 1 mm or more to less than 2 mm in diameter)

B: Density decrease 0.1 to less than 0.2

C: Density decrease 0.2 and more (9) Fusion of the Toner to a Drum:

After 400,000-sheet duration printing test with the drum heater kept at 49° C. in an environment of 32° C. and 80% RH, the appearance of white points on the solid black image was evaluated.

A: No white points appeared

B: Less than 10 white points appeared

C: 10 or more white points appeared

(10) Cripping of the cleaning blade:

After 300,000-sheet duration printing test on A4 size plain paper in an environment of 23° C. and 5% RH, cripping occurrence of the cleaning blade was judged on the basis of the condition of the cleaning blade and the resulting image fault such as a black stripe(s).

A: No cripping of the cleaning blade

B: 3 or less crippings of the cleaning blade

C: 4 or more crippings of the cleaning blade

Examples 2 to 8

Toners No. 2 to 8 were each prepared in accordance with the formulation shown in Table 10 in the same manner as in Example 1. Table 11 shows the physical property values of the toners thus obtained, and Tables 12 to 15 each show the results of tests for the toners similar to those described above. Further, the Kneading condition 2 means the following condition that the heating temperature of the first kneading place is 150° C., the heating temperature of the second kneading place is 150° C., the frequency of the paddle is 200 rpm.

Comparative Examples 1 to 5

Toners No. 9 to 13 were each prepared in accordance with the formulation shown in Table 10 in the same manner as in Example 1. Table 11 shows the physical property values of the toners thus obtained, and Tables 12 to 15 each show the results of tests for the toners similar to those described above.

Example 9

(Preparation of toner No. 14)

| | |
|---|---|
| Binder Resin a | 60 parts by mass |
| Binder Resin A | 40 parts by mass |
| Charge control agent-2 (shown below) | 2 parts by mass |
| Carbon black | 5 parts by mass |
| Wax 1 | 5 parts by mass |

[Chem 3]

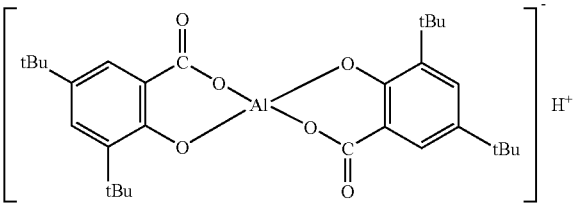

Charge control agent-2

A toner No. 14 was prepared in accordance with the above formulation in the same manner as in Example 1. Further, magenta toner 1 was prepared with the same manner as of Toner 14 other than using Pigment Red 57 instead of carbon black. Still further, yellow toner 1 was prepared with the same manner as of Toner 14 other than using Pigment Yellow 74 instead of carbon black. Still more further, cyan toner 1 was prepared with the same manner as of Toner 14 other than using Pigment Blue 15:3 instead of carbon black. YMCK full-color one-component development evaluation was performed by using the magenta toner 1, yellow toner 1, cyan toner 1 and Toner 14.

Good results were obtained for the above evaluation items evaluated at Example 1. Further, the transparency of an OHP image obtained by projecting a color image formed on a transparency film onto an overheadd projector (OHP) was also good.

TABLE 10

| Toner formulation | | | | | | |
|---|---|---|---|---|---|---|
| | Toner No. | Kind of low molecular weight body (L) | Kind of high molecular weight body (H) | Wax | Addition ratio L/H/Wax | Kneading condition |
| Example 1 | 1 | Binder resin a | Binder resin A | 1 + 2 | 60/40/3/2 | 1 |
| Example 2 | 2 | Binder resin b | Binder resin A | 1 + 2 | 60/40/3/2 | 1 |
| Example 3 | 3 | Binder resin c | Binder resin A | 1 + 2 | 60/40/3/2 | 1 |
| Example 4 | 4 | Binder resin d | Binder resin A | 1 + 2 | 60/40/3/2 | 1 |
| Example 5 | 5 | Binder resin e | Binder resin A | 1 + 2 | 60/40/3/2 | 1 |
| Example 6 | 6 | Binder resin f | Binder resin A | 1 + 2 | 60/40/3/2 | 1 |
| Example 7 | 7 | Binder resin g | Binder resin A | 1 | 30/70/5 | 2 |
| Example 8 | 8 | Binder resin a | Binder resin A | 1 | 30/70/5 | 1 |
| Comparative Example 1 | 9 | Binder resin h | Binder resin A | 2 | 30/70/5 | 1 |
| Comparative Example 2 | 10 | Binder resin i | Binder resin A | 2 | 40/60/5 | 2 |
| Comparative Example 3 | 11 | Binder resin j | Binder resin A | 4 | 40/60/5 | 2 |
| Comparative Example 4 | 12 | Binder resin j | Binder resin A | 3 | 90/10/5 | 2 |
| Comparative Example 5 | 13 | Binder resin k | Binder resin B | 2 | 50/50/5 | 2 |

TABLE 11

| List of physical properties of toners | | | | | | | | | | | |
|---|---|---|---|---|---|---|---|---|---|---|---|
| | Results of GPC-RALLS-viscometer analysis | | | | | | | | | | |
| | Peak top | | | | Entire peak | | | | | | |
| | Mp | Rt | Rp | Rt/Rp | Rgw | Ratio of molecules each having an square radius of inertia of 5 nm or less | Ratio of molecules each having a molecular weight of 20,000 or less | Ivw | Softening point (° C.) | Tg (° C.) | ΔH2/ΔH1 |
| Toner 1 | 14030 | 3.2 | 4.9 | 0.65 | 11.3 | 66.3 | 49.2 | 0.23 | 119.7 | 55.9 | 1.9 |
| Toner 2 | 17800 | 3.1 | 5.6 | 0.55 | 11.8 | 62.0 | 45.0 | 0.24 | 121.2 | 56.1 | 2.2 |
| Toner 3 | 11500 | 2.9 | 4.4 | 0.66 | 10.7 | 69.0 | 53.7 | 0.22 | 118.4 | 55.7 | 1.9 |
| Toner 4 | 17100 | 3.4 | 5.5 | 0.62 | 11.6 | 68.2 | 48.2 | 0.24 | 122.1 | 56.1 | 2.3 |
| Toner 5 | 19500 | 3.1 | 5.9 | 0.53 | 11.8 | 67.1 | 43.4 | 0.31 | 123.3 | 57.3 | 2.4 |
| Toner 6 | 10900 | 3.5 | 4.2 | 0.82 | 10.2 | 69.4 | 55.8 | 0.19 | 118.9 | 55.4 | 1.6 |
| Toner 7 | 13800 | 3.2 | 4.8 | 0.66 | 11.1 | 66.3 | 47.2 | 0.21 | 118.7 | 55.9 | 2.4 |
| Toner 8 | 18300 | 3.6 | 5.7 | 0.63 | 12.4 | 57.2 | 33.7 | 0.26 | 121.5 | 56.1 | 2.5 |
| Toner 9 | 14100 | 3.9 | 4.9 | 0.80 | 15.2 | 55.1 | 47.1 | 0.27 | 122.1 | 56.2 | 1.3 |
| Toner 10 | 19300 | 4.3 | 5.8 | 0.74 | 14.7 | 48.7 | 24.1 | 0.22 | 121.7 | 56.4 | 1.4 |

TABLE 11-continued

| List of physical properties of toners | | | | | | | | | | | |
|---|---|---|---|---|---|---|---|---|---|---|---|
| | Results of GPC-RALLS-viscometer analysis | | | | | | | | | | |
| | Peak top | | | | Entire peak | | | | | | |
| | Mp | Rt | Rp | Rt/Rp | Rgw | Ratio of molecules each having an square radius of inertia of 5 nm or less | Ratio of molecules each having a molecular weight of 20,000 or less | Ivw | Softening point (° C.) | Tg (° C.) | ΔH2/ΔH1 |
| Toner 11 | 10500 | 3.9 | 4.2 | 0.94 | 12.4 | 53.8 | 75.2 | 0.19 | 124.3 | 56.1 | 1.2 |
| Toner 12 | 8100 | 3.5 | 3.6 | 0.97 | 5.6 | 64.1 | 88.3 | 0.15 | 114.6 | 54.2 | 1.2 |
| Toner 13 | 41000 | 4.8 | 8.9 | 0.54 | 17.2 | 32.0 | 1.1 | 0.47 | 136.1 | 56.1 | 1.1 |

TABLE 12

| Results of evaluation | | | | | | | | | |
|---|---|---|---|---|---|---|---|---|---|
| | | | | | | | | Cleaning property | |
| | Fixability | Fixability (bending test) | Offset resistance | Low-pressure gloss value | Durable stability of gloss | Storage stability | Bonding of discharged paper property | Crippings of the cleaning blade | Fusion of the toner to a drum |
| Example 1 | A | A | A | 19% | A | A | A1 | A | A |
| Example 2 | A | A | A | 16% | A | A | A1 | A | A |
| Example 3 | A | A | A | 19% | A | A | A1 | A | A |
| Example 4 | A | A | A | 18% | A | A | A1 | A | A |
| Example 5 | A | A | A | 15% | A | A | A1 | A | A |
| Example 6 | A | B | A | 20% | A | A | A2 | A | A |
| Example 7 | A | A | A | 19% | A | A | A2 | A | A |
| Example 8 | A | A | A | 10% | A | A | A3 | A | A |
| Comparative Example 1 | A | B | A | 8% | C | A | B | B | B |
| Comparative Example 2 | B | B | A | 7% | B | B | B | B | B |
| Comparative Example 3 | A | C | B | 3% | B | B | C | B | B |
| Comparative Example 4 | A | D | C | 4% | B | C | C | C | C |
| Comparative Example 5 | C | B | B | 5% | C | B | C | C | C |

TABLE 13

| Results of evaluation of each toner at high temperature and high humidity (32° C., 80% RH) | | | | |
|---|---|---|---|---|
| | Initial stage | | After 300,000-sheet duration | |
| | Density | Fogging | Density | Fogging |
| Example 1 | 1.45 | 0.70 | 1.44 | 0.50 |
| Example 2 | 1.45 | 0.90 | 1.42 | 0.90 |
| Example 3 | 1.46 | 0.80 | 1.45 | 0.50 |
| Example 4 | 1.42 | 0.80 | 1.40 | 0.90 |
| Example 5 | 1.41 | 0.40 | 1.39 | 0.60 |
| Example 6 | 1.46 | 0.50 | 1.41 | 0.20 |
| Example 7 | 1.41 | 0.80 | 1.40 | 0.80 |
| Example 8 | 1.38 | 0.80 | 1.34 | 1.00 |

TABLE 13-continued

| Results of evaluation of each toner at high temperature and high humidity (32° C., 80% RH) | | | | |
|---|---|---|---|---|
| | Initial stage | | After 300,000-sheet duration | |
| | Density | Fogging | Density | Fogging |
| Comparative Example 1 | 1.35 | 1.00 | 1.31 | 1.20 |
| Comparative Example 2 | 1.34 | 1.10 | 1.25 | 1.30 |
| Comparative Example 3 | 1.30 | 1.30 | 1.20 | 1.50 |
| Comparative Example 4 | 1.21 | 1.50 | 1.19 | 2.00 |
| Comparative Example 5 | 1.20 | 1.10 | 0.98 | 1.30 |

TABLE 14

| Results of evaluation of each toner at normal temperature and normal humidity (23° C., 60% RH) | | | | |
|---|---|---|---|---|
| | Initial stage | | After 300,000-sheet duration | |
| | Density | Fogging | Density | Fogging |
| Example 1 | 1.43 | 0.70 | 1.43 | 0.50 |
| Example 2 | 1.42 | 1.10 | 1.42 | 1.20 |
| Example 3 | 1.42 | 0.80 | 1.41 | 0.90 |
| Example 4 | 1.42 | 0.80 | 1.42 | 0.90 |
| Example 5 | 1.41 | 1.20 | 1.37 | 1.30 |
| Example 6 | 1.44 | 0.60 | 1.42 | 0.50 |
| Example 7 | 1.42 | 0.80 | 1.41 | 0.80 |
| Example 8 | 1.38 | 0.80 | 1.36 | 1.00 |
| Comparative Example 1 | 1.32 | 1.10 | 1.30 | 1.50 |
| Comparative Example 2 | 1.30 | 1.30 | 1.26 | 1.70 |
| Comparative Example 3 | 1.25 | 1.60 | 1.21 | 2.30 |
| Comparative Example 4 | 1.18 | 2.50 | 1.12 | 3.40 |
| Comparative Example 5 | 1.15 | 1.50 | 1.00 | 1.70 |

TABLE 15

| Results of evaluation of each toner at normal temperature and low humidity (23° C., 5% RH) | | | | |
|---|---|---|---|---|
| | Initial stage | | After 300,000-sheet duration | |
| | Density | Fogging | Density | Fogging |
| Example 1 | 1.43 | 0.80 | 1.43 | 0.70 |
| Example 2 | 1.42 | 1.20 | 1.42 | 1.40 |
| Example 3 | 1.42 | 0.80 | 1.41 | 0.90 |
| Example 4 | 1.42 | 0.90 | 1.42 | 0.90 |
| Example 5 | 1.41 | 1.30 | 1.37 | 1.50 |
| Example 6 | 1.43 | 0.60 | 1.42 | 0.60 |
| Example 7 | 1.42 | 0.90 | 1.41 | 1.10 |
| Example 8 | 1.38 | 0.80 | 1.36 | 1.20 |
| Comparative Example 1 | 1.30 | 1.20 | 1.25 | 1.90 |
| Comparative Example 2 | 1.26 | 1.40 | 1.21 | 2.30 |
| Comparative Example 3 | 1.22 | 1.80 | 1.20 | 2.60 |
| Comparative Example 4 | 1.14 | 2.90 | 1.03 | 3.80 |
| Comparative Example 5 | 1.12 | 1.80 | 1.02 | 2.00 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-321883, filed Nov. 7, 2005, which is hereby incorporated by reference herein in its entirety.

What is claimed is:

1. A toner, comprising at least:

a binder resin which includes a high-molecular weight resin and a branched low molecular weight resin; and a colorant, wherein:

a softening point of the high-molecular weight resin measured by using a flow tester is 110 to 150° C.;

a softening point of the branched low molecular weight resin measured by using a flow tester is 80 to 105° C.;

a square radius of inertia Rt at a peak top of a main peak in GPC-RALLS-viscometer analysis of tetrahydrofuran (THF) soluble matter when the toner is dissolved in a THF solvent at 25° C. for 24 hours is 1.0 nm to 3.8 nm;

the square radius of inertia Rt and an square radius of inertia Rp at a peak top of a main peak in GPC-RALLS-viscometer analysis of THF soluble matter when linear polystyrene, having an absolute peak molecular weight value at the same value as a main peak value of the toner, is dissolved in a THF solvent at 25° C. for 24 hours satisfy the following expression 1

$$0.10<Rt/Rp<0.80 \quad \text{(Ex. 1); and}$$

a square radius of inertia RgL at a peak top of a main peak in GPC-RALLS-viscometer analysis of THF soluble matter when the branched low molecular weight resin is dissolved in a THF solvent at 25° C. for 24 hours and a square radius of inertia Rgp at a peak top of a main peak in GPC-RALLS-viscometer analysis of THF soluble matter when linear polystyrene, having an absolute peak molecular weight value at the same value as a main peak value of the branched low molecular weight resin, is dissolved in a THF solvent at 25° C. for 24 hours satisfy the following expression 2:

$$0.50<RgL/Rgp<0.80 \quad \text{(Ex. 2),}$$

wherein the low molecular weight resin has a peak molecular weight MpL according to the GPC-RALLS viscometer analysis of THF soluble matter of 5,000 to 20,000, wherein the high-molecular weight resin has a peak molecular weight MpH according to the GPC-RALLS viscometer analysis of THF soluble matter of 10,000 to 40,000, wherein the branched low molecular weight resin is a hybrid resin in which a polyester unit and a vinyl polymer unit are chemically bound to each other, and wherein the polyester unit is formed from a trivalent or more carboxylic acid monomer or an acid anhydride of the trivalent or more carboxylic acid monomer in an amount from 0.6 to 6.2 mol %.

2. A toner according to claim 1, wherein heat of formation ΔH1 (J/g) of an endothermic main peak upon temperature increase in a DSC curve of the toner measured with a differential scanning calorimeter and heat of formation ΔH2 (J/g) of an endothermic main peak upon temperature increase in a DSC curve of the THF soluble matter measured with the differential scanning calorimeter when the toner is extracted by Soxhlet extraction for 16 hours satisfy the following relational expression 3:

$$1.5<\Delta H2/\Delta H1<2.5 \quad \text{Ex. 3.}$$

* * * * *